US007426363B2

(12) United States Patent
Murakami et al.

(10) Patent No.: US 7,426,363 B2
(45) **Date of Patent: *Sep. 16, 2008**

(54) DEVELOPER SUPPLY CONTAINER WITH SHUTTER MOVEMENT PREVENTION FEATURE

(75) Inventors: Katsuya Murakami, Toride (JP); Toshiaki Nagashima, Moriya (JP); Nobuo Nakajima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/833,514

(22) Filed: Aug. 3, 2007

(65) Prior Publication Data

US 2008/0013988 A1 Jan. 17, 2008

Related U.S. Application Data

(62) Division of application No. 10/988,501, filed on Nov. 16, 2004, now Pat. No. 7,266,330.

(30) Foreign Application Priority Data

Nov. 19, 2003 (JP) ..... 2003-388832
Nov. 12, 2004 (JP) ..... 2004-328675

(51) Int. Cl.
*G03G 15/08* (2006.01)
*G03G 15/04* (2006.01)

(52) U.S. Cl. ..... 399/262; 399/119

(58) Field of Classification Search ..... 399/98, 399/119, 120, 258, 262, 263, 260
See application file for complete search history.

(56) References Cited

U.S. PATENT DOCUMENTS 5,475,469 A 12/1995 Okada et al.
5,568,237 A 10/1996 Ishida et al.

(Continued)

FOREIGN PATENT DOCUMENTS

DE 197 17 279 A1 11/1997

(Continued)

OTHER PUBLICATIONS

Communication Pursuant to Article 94(3) EPC, dated Feb. 12, 2008, issued in counterpart European Application No. 04 027 425.0-2225.

*Primary Examiner*—Sandra L Brase
(74) *Attorney, Agent, or Firm*—Fitzpatrick, Cella, Harper & Scinto

(57) ABSTRACT

A developer supply container detachably mountable to a developer receiving device having a receiving opening for receiving a developer, an apparatus shutter for opening and closing the receiving opening, the developer supply container including a container body for containing the developer, the container body including a discharge opening for discharging the developer; a container shutter for opening and closing the discharge opening by a rotational movement of the container body with the container shutter being prevented from moving by the developer receiving device; an interrelating portion for interrelating the rotational movement of the apparatus shutter with the container body such that apparatus shutter starts moving when a neighborhood of a leading, with respect to a moving direction thereof, end of the discharge opening exposed by the container shutter, is substantially aligned with a neighborhood of a trailing edge of the apparatus shutter.

4 Claims, 13 Drawing Sheets

U.S. PATENT DOCUMENTS

| | | | |
|---|---|---|---|
| 5,579,101 | A | 11/1996 | Omata et al. |
| 5,593,068 | A | 1/1997 | Kitayama et al. |
| 5,608,501 | A | 3/1997 | Makino |
| 5,630,198 | A | 5/1997 | Makino |
| 5,678,147 | A | 10/1997 | Makino |
| 5,697,014 | A | 12/1997 | Makino |
| 5,761,585 | A | 6/1998 | Makino |
| 5,771,427 | A | 6/1998 | Makino |
| 5,832,343 | A | 11/1998 | Kobayashi et al. |
| 6,438,345 | B1 | 8/2002 | Ban et al. |
| 6,728,500 | B2 | 4/2004 | Naito et al. |
| 7,266,330 | B2 * | 9/2007 | Murakami et al. ..... 399/262 |

FOREIGN PATENT DOCUMENTS

| | | | |
|---|---|---|---|
| EP | 1 184 741 | A2 | 3/2002 |
| GB | 2312760 | * | 11/1997 |
| GB | 2312760 | A | 11/1997 |
| JP | 63-86652 | U | 6/1988 |
| JP | 5-216344 | A | 8/1993 |
| JP | 7-199623 | A | 8/1995 |
| JP | 10-48938 | A | 2/1998 |
| JP | 10-55103 | A | 2/1998 |

* cited by examiner (a)

(b)

(c)

COMP. EXAMPLE 1

COMP. EXAMPLE 3

DEVELOPER SUPPLY CONTAINER WITH SHUTTER MOVEMENT PREVENTION FEATURE

This application is a divisional of U.S. patent application Ser. No. 10/988,501, filed Nov. 16, 2004.

FIELD OF THE INVENTION AND RELATED ART

The present invention relates to a developer supply container for supplying the developer receiving apparatus of such an electrophotographic image forming apparatus as a copying machine, a facsimile machine, a printer, etc., with developer.

In the field of such an image forming apparatus as an electrophotographic copying machine, a printer, etc., toner in the form of extremely minute particles has been used as developer, and it has been a common practice that as the toner in the main assembly of an image forming apparatus is depleted by consumption, a toner supply container is used to supply the image forming apparatus with toner. However, since the toner is in the form of extremely small particles, there has been the problem that during an operation for supplying an image forming apparatus with toner, toner scatters, contaminating an operator, and/or the adjacencies of the apparatus. Thus, various methods for preventing this problem have been proposed, and some of them have been put to practical use. According to some of these methods, a toner supply container is placed in the main assembly of an image forming apparatus, and the toner in the toner supply container is released into the main assembly little by little through the small hole with which the toner supply container is provided.

First, the toner supply container used with one of the above-mentioned methods for supplying the main assembly of an image forming apparatus will be briefly described.

For example, Japanese Laid-open Patent Application 7-199623 (which corresponds to U.S. Pat. No. 5,579,101) discloses the following method: The developing apparatus is provided with a shutter for keeping the toner reception hole thereof, and the toner supply container is provided with a pair of projections, which are positioned on the peripheral surface of the container proper of the developer supply container, being aligned in the direction parallel with the axial direction of the container, so that as the cylindrical toner supply container is rotated after it is mounted in the main assembly of the image forming apparatus, the shutter of the developing apparatus is pushed open by the pair of projections of the developer supply container, connecting the toner discharge hole of the toner supply container to the toner reception hole of the developing apparatus, allowing thereby the toner in the toner supply container to be supplied to the developing apparatus.

There has long been a strong desire for a structural arrangement for such a toner supply container as the above-described one, that substantially reduces the amount of the contamination of a toner supply container, and a developing apparatus, by the toner from the toner supply container, after the toner discharge from the toner supply container during the replenishment of the main assembly of an image forming apparatus with toner.

According to the methods disclosed in Japanese Laid-open Patent Applications 10-48938 and 10-55103 (which correspond to U.S. Pat. Nos. 5,630,198, 5,678,147, 5,761,585, 5,697,014, and 5,771,427), the toner supply container is provided with a shutter for the toner outlet of the toner supply container, and is placed next to the developing apparatus in the main assembly of an image forming apparatus. The toner supply container, and the developing apparatus of the image forming apparatus, are structured so that when the toner supply container is rotated in the main assembly of an image forming apparatus, the shutter is prevented from rotating. Therefore, as the developer supply container is rotated, the toner outlet of the toner supply container is opened, and at the same time, the shutter of the developing apparatus, which is engaged with the toner supply container, is also opened by the rotation of the toner supply container, creating a passage through which the toner is supplied from the toner supply container to the developing apparatus.

According to the method disclosed in Japanese Laid-open U. M. Application 63-86652, the toner supply container is provided with a pair of projections, which are located at the lengthwise ends of the peripheral surface of the toner supply container, one for one, whereas the shutter of the developing apparatus in the main assembly of the image forming apparatus is provided with a pair of holes, into which the pair of the projections of the toner supply container fits. Thus, as the toner supply container is rotated after the mounting of the toner supply container into the main assembly of an image forming apparatus, the pair of the projections of the toner supply container fit into the pair of holes of the shutter of the developing apparatus, opening or closing the shutter.

However, the toner supply container structured as disclosed in the above-mentioned Japanese Laid-open Patent Application 199623 has the following problem, because it is not provided with the mechanism for opening or closing the shutter of the toner supply container. More specifically, it is structured so that when removing it from the main assembly of an image forming apparatus, the opening of its toner outlet faces upward to prevent the toner from coming out. However, without the shutter, and the mechanism for moving the shutter for opening or closing the toner outlet, there is the possibility that the toner will come out of the toner supply container even though by only a small amount, if the toner supply container happens to be placed upside down after its removal. Therefore, this toner supply container is desired to be improved in terms of usability.

The toner supply container structured as disclosed in the above-mentioned Japanese Laid-open U. M. Application 63-86652 is problematic in that it is very complicated in design, because of the positional relation between the pair of projections which project from the lengthwise ends of the toner supply container which is rotationally moved, and the shutter of the developing apparatus, which is linearly moved; from the standpoint of design, it is very difficult to make such a structural arrangement that ensures that as the toner supply container is rotated, the pair of projections located at the lengthwise ends of the container fit into the pair of holes of the shutter. Further, there is the possibility that if the pair of projections are forced into the pair of holes, the shutter mechanism will be damaged. Moreover, the structural arrangement is made to ensure that not only is the shutter completely closed, but also, the pair of projections at the lengthwise ends of the container are disengaged from the pair of holes of the shutter is also problematic.

Further, in the case of the structural arrangement disclosed in the above-mentioned Japanese Laid-open Patent Application 10-55103, there is provided a member for covering the opening of the toner outlet of the toner supply container. Therefore, it is possible to prevent the problem that contamination is caused by the toner which comes out of the toner supply container after its removal from the main assembly of an image forming apparatus. However, the shutter of the developing apparatus is structured so that it is rotationally moved by the rotation of the toner supply container as soon as the toner supply container is rotated. Therefore, there is the problem that as soon as the toner supply container begins to be rotated, the shutter of the developing apparatus is opened, allowing the toner in the developing apparatus to adhere to (contaminate) the peripheral surface of the toner supply container.

As a result, when an operator removes the toner supply container from the main assembly of the image forming apparatus, the operator is contaminated by the toner adhering to the peripheral surface of the toner supply container. In addition, the developing apparatus is also contaminated by the toner when the opening of the toner outlet of the toner supply container is resealed. This contamination on the developing apparatus side occurs every time the toner supply container is replaced, allowing the toner to accumulate on the developing apparatus side. As a result, a problem occurs that is similar to the problem that occurs as the toner outlet of the toner supply container is opened; the peripheral surface of the toner supply container is contaminated in a manner similar to the manner in which the peripheral surface of the toner supply container is contaminated as the toner outlet of the toner supply container is opened.

SUMMARY OF THE INVENTION

The primary object of the present invention is to provide a developer supply container which does not suffer from the problem that as the developer supply container is rotated to open the developer outlet of the developer supply container, the developer supply container is contaminated by the developer.

Another object of the present invention is to provide a developer supply container which does not suffer from the problem that as the developer supply container is rotated to reseal the developer outlet of the developer supply container, the developer supply container is contaminated by the developer.

Another object of the present invention is to provide a developer supply container which is simple in structure, and yet, is capable of reliably opening or closing the shutter on the main assembly side.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. The measurements, materials, and configurations of the structural components, the positional relationship among them, etc., in the preferred embodiments of the present invention, which will be described hereinafter, are to be modified, as necessary, according to the structure of the apparatus to which the present invention is applied, and/or the various conditions under which the apparatus is operated. In other words, they are not intended to limit the scope of the present invention, unless specifically noted.

First, referring to FIG. 1, an electrophotographic copying machine, as an example of an electrophotographic image forming apparatus in which the toner supply container, as a developer supply container, is mounted, will be described with regard to its structure.

Figure 1:
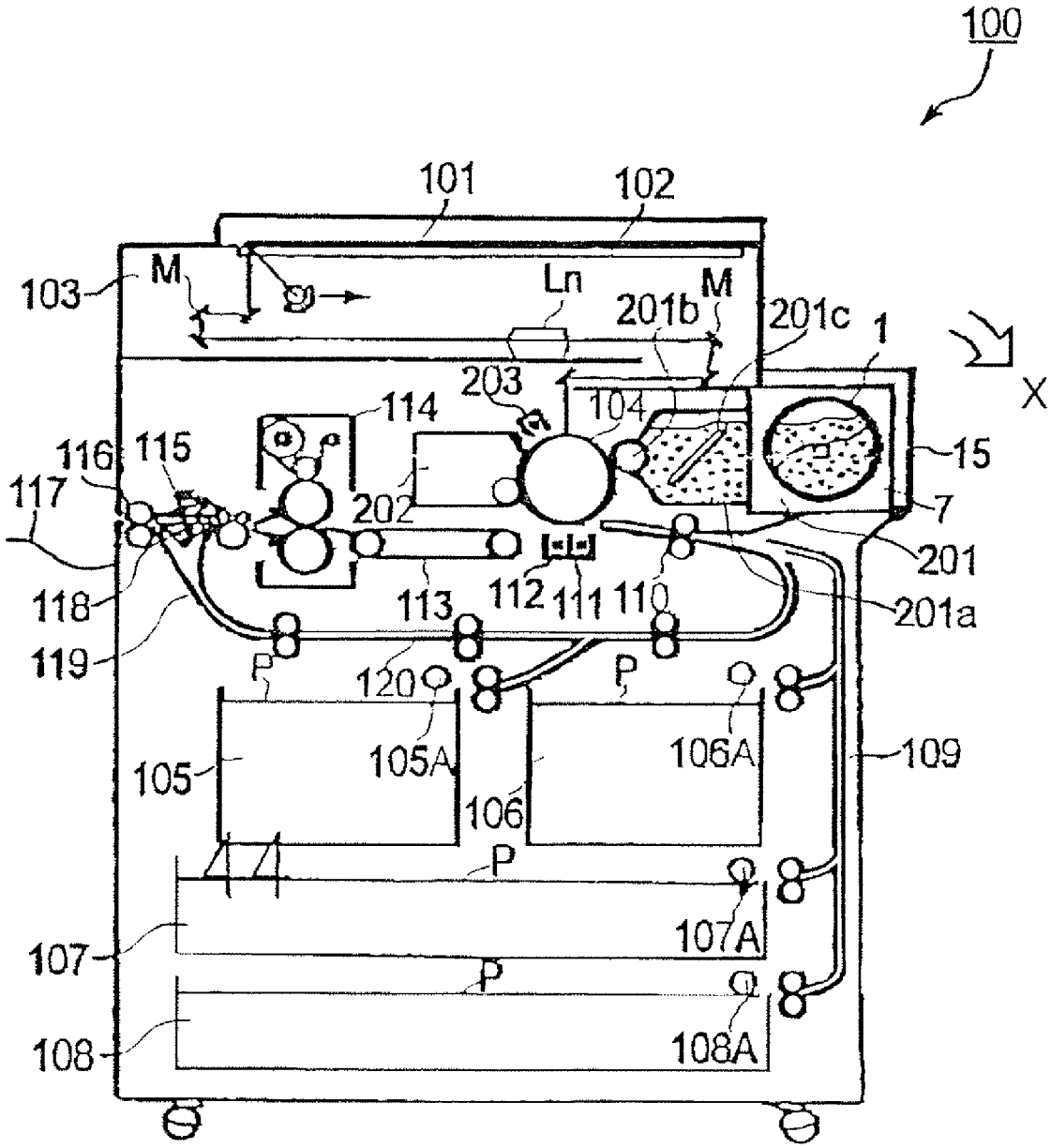
FIG. 1 is a schematic sectional view of a typical electrophotographic image forming apparatus in which the toner supply container in one of the preferred embodiments of the present invention is mountable, showing the structure thereof.

In FIG. 1, designated by a referential number 100 is the main assembly of the electrophotographic copying machine (which hereinafter will be referred to as apparatus main assembly). Designated by a referential number 101 is an original, which is placed on a glass platen 102. An optical image in accordance with the image formation data is formed on the electrophotographic photosensitive drum 104 by the combination of a plurality of mirrors M and a plurality of lenses Ln. Designated by referential numbers 105-108 are cassettes, from among which the cassette containing recording mediums (which hereinafter may be referred to simply as papers) P, which agree in size with the information inputted by an operator through the control panel, or are the most suitable to the size of the original 101, is selected, based on the information regarding the sizes of the papers in the cassettes 105-108. The recording medium does not need to be limited to paper. For example, an OHP sheet or the like may be used as necessary.

The papers P are conveyed one by one by separating and conveying apparatuses 105A-108A, to a pair of registration rollers 110 by way of a paper conveyance path 109. Then, each paper P is conveyed further by the pair of registration rollers 110 in synchronism with the rotation of the photosensitive drum 104 and the scanning timing of the optical portion 103. Designated by referential numbers 111 and 112 are a transfer discharger for transferring the toner image formed on the photosensitive drum 104, onto the paper P, and a separation discharger for separating the paper P from the photosensitive drum 104 after the transfer of the toner image onto the paper P, respectively.

Thereafter, the paper P is further conveyed by a paper conveying portion 113 to the fixation station 114, in which the toner image on the paper P is fixed by heat and pressure. Then, when the copying machine is in the single-sided print mode, the paper P is moved through the reversing station, without being placed upside down, and is discharged into the delivery tray 117 by a pair of discharge rollers 116. When the machine is in the two-sided print mode, the flapper 118 of the reversing station 115 is controlled so that the paper P is conveyed to the pair of registration rollers 110 by way of re-feeding conveyance paths 119 and 120. Then, the paper P is made to move through the same paths as those through which the paper P is moved when the machine is in the single-sided print mode, and is discharged into the delivery tray 117.

When the machine is in the multilayer print mode, the paper P is sent through the reversing station 115 so that it is stopped after it is partially extended outward from the main assembly by the pair of discharge rollers 116. More specifically, it is stopped immediately after the trailing edge of the paper P is moved past the flapper 118, while the paper P is remaining pinched by the pair of discharge rollers 116. Then, the flapper 118 is switched in position, and the pair of discharge rollers 116 are rotated in reverse so that the paper P is conveyed back into the main assembly. Thereafter, the paper P is conveyed to the registration rollers 110 through paper re-conveyance paths 119 and 120. Then, it is moved through the same paths as those through which it is moved when the machine is in the single-side print mode, and discharged into the delivery tray 117.

In the main assembly 100 of the copying machine structured as described above, the development station 201, cleaning station 202, primary charging station (primary charger 203), etc., are disposed in the adjacencies of the peripheral surface of the drum 104. The development station 201 is the station in which the electrostatic latent image formed on the peripheral surface of the drum 104 by the optical station 103, based on the image formation data extracted from the original 101, is developed with the use of toner. The toner supply container 1 for supplying this development station 201 with toner is to be removably mounted in the main assembly 100 of the copying machine by a user.

The development station 201 comprises a toner receiving apparatus 7 in which the toner supply container 1 is removably mounted, and a developing device 201*a*. Further, the developing device 201*a* comprises a development roller 201*b* and a developer conveying member 201*c*. After being supplied from the toner supply container 1 into the toner receiving apparatus 7, the toner is sent by the conveying member 201*c* to the development roller 201*b*, by which the toner is supplied to the photosensitive drum 104.

The cleaning station 202 is where the toner remaining on the peripheral surface of the photosensitive drum 104 is removed. The primary charger 203 is for charging the photosensitive drum 104.

The main assembly 100 is provided with a cover for the replacement of a toner supply container, which constitutes a part of the external shell of the main assembly 100, and which is opened in the direction indicated by an arrow mark X in FIG. 1, when a user mounts the toner supply container 1 into the apparatus main assembly 100 or removes it therefrom.

Embodiment 1

Next, referring to FIGS. 12(*a*)-12(*c*), the toner supply container 1 as a developer supply container in this embodiment will be described regarding its structure.

The container proper 1*a* of the toner supply container 1, in which toner is stored, is a hollow and roughly cylindrical member. The cylindrical wall of the container proper 1*a* is provided with a hole 1*b* as an toner outlet, which is roughly in the form of a rectangle, the longer edges of which are parallel with the lengthwise direction of the container proper 1*a*. The container proper 1*a* is also provided with a toner filling hole 1*c*, which is a part of one of the lengthwise end walls of the container proper 1*a*, and which is sealed with an unshown sealing member or the like after the filling of the container proper 1*a* with toner. The toner supply container 1 is also provided with a handle 2, which is to be grasped by a user when the user is mounting the toner supply container 1 into the apparatus main assembly 100 or removing it therefrom. The handle 2 is anchored to the lengthwise ends of the toner supply container 1. The configuration of the handle 2 does not need to be limited to the one in this embodiment. In other words, the handle 2 may be in any configuration as long as it can be used when a user is mounting or dismounting the toner supply container 1, and also, as long as it is satisfactory in terms of the function of rotating the toner supply container 1.

Figure 2:
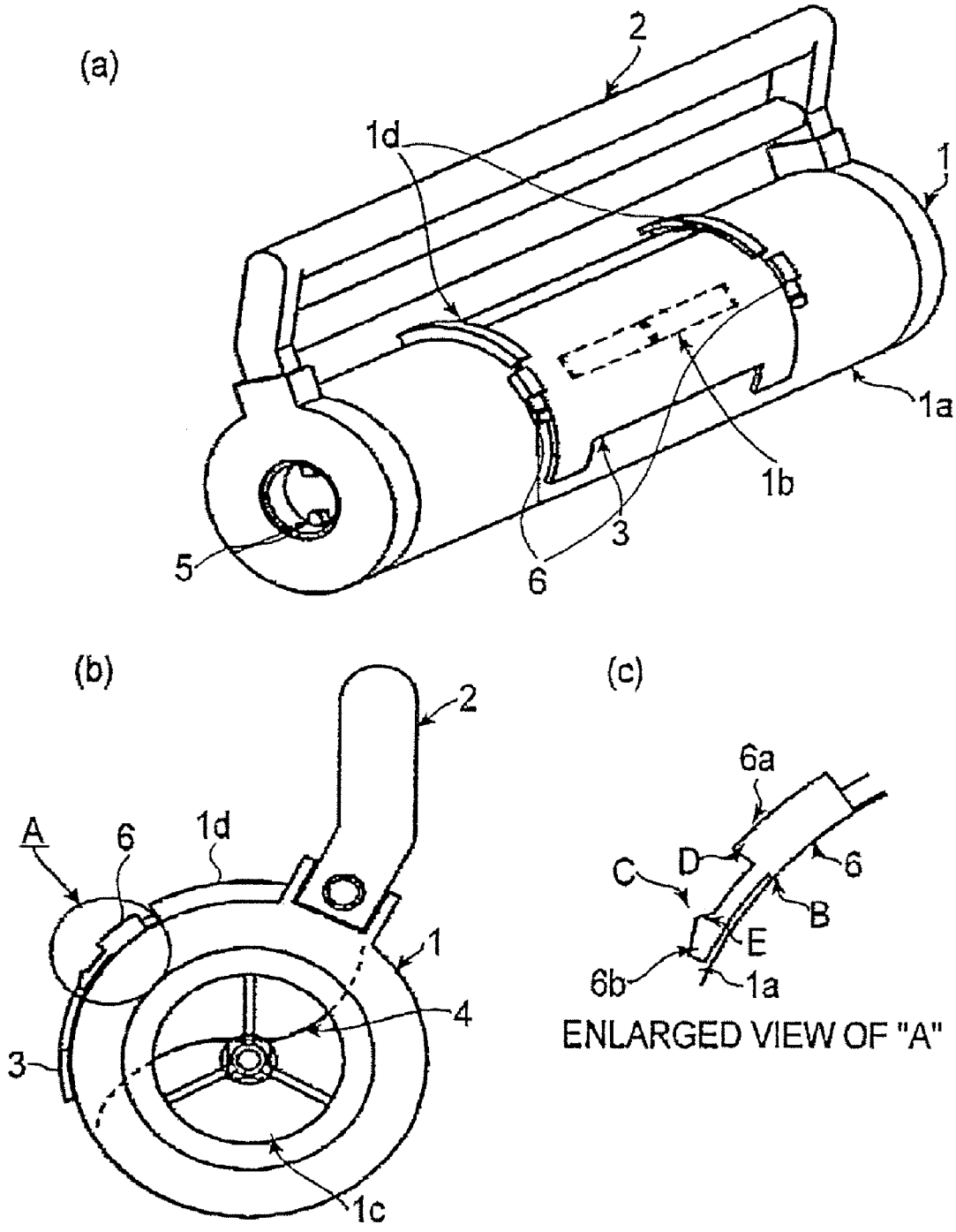
FIGS. 2(*a*) and 2(*b*) are perspective and side views, respectively, of the toner supply container in the first embodiment of the present invention, and FIG. 2(*c*) is an enlarged view of the portion A in FIG. 2(*b*).

Referring to FIG. 2(*a*), the hole 1*b* is kept sealed by the shutter 3, the curvature of which matches that of the peripheral wall of the toner supply container 1. The shutter 3 is engaged with a pair of guiding members 1*d* located at the length-wise ends of the hole 1*b*, being allowed to slide along the peripheral surface of the container proper 1*a* in the circumferential direction of the container proper 1*a*.

The toner supply container 1 and its shutter 3 are structured so that when the toner supply container 1 is rotated after the mounting of the toner supply container 1 into the toner receiving apparatus 7, the shutter 3 is prevented, by coming into contact with a predetermined portion of the toner receiving apparatus 7, from rotating with the container proper 1*a*, as will be described later in detail.

With the toner supply container 1 and its shutter 3 structured as described above, as the toner supply container 1 is rotated after it is mounted into the toner receiving apparatus 7, the shutter 3 is moved relative to the container proper 1*a*, exposing the hole 1*b*.

On the other hand, when replacing the toner supply container 1, the toner supply container 1 is to be rotated in the direction opposite to the direction in which the toner supply container 1 is rotated in order to expose the hole 1*b*. As the toner supply container 1 is rotated in the reverse direction, the shutter 3 comes into contact with another predetermined portion of the toner receiving apparatus so that the rotation of the shutter 3 is regulated. As the toner supply container 1 is rotated further after its shutter comes into contact with the predetermined portion of the toner receiving apparatus 7, the shutter 3 is moved, relative to the container proper 1*a*, to the location at which the shutter 3 covers the hole 1*b*, resealing the hole 1*b* (toner supply container 1).

The toner supply container 1 is provided with a stirring member 4, which is located in the container proper 1*a*, and a stirring member driving gear 5, which is located at the lengthwise end of the container proper 1*a*, opposite to where the toner filling hole 1*c* is located, and which is connected to the stirring member so that the stirring member rotates with the gear 5. More specifically, the toner supply container 1 is structured so that after the toner supply container mounted in the main assembly of the image forming apparatus is readied for toner discharge, the driving force from the main assembly is transmitted to the stirring member 4 through the gear 5 in order to rotationally move the stirring member 4 relative to the container proper 1*a* so that the toner within the toner supply container 1 is discharged from the toner supply container 1 through the hole 1*b*.

The container proper 1*a* is provided with a pair of projections 6, as members for controlling the rotational movement of the apparatus shutter 8, or the shutter on the main assembly side of the image forming apparatus, so that the apparatus shutter 8 is moved by the movement of the toner supply container 1. The pair of projections 6 are configured and positioned so that as the toner supply container 1 is mounted into the toner receiving apparatus 7, they engage with the apparatus shutter 8.

More specifically, referring to FIG. 2(*c*), each projection 6 has a portion 6*a* and a portion 6*b*. The portion 6*a* is a hole unsealing portion for pushing down the apparatus shutter 8. More specifically, as the toner supply container 1 is rotated, the surface D of the portion 6*a* comes into contact with the apparatus shutter 8, and pushes the apparatus shutter 8, unsealing the hole 7*b* of the toner receiving apparatus 7, which will be described later. The portion 6*b*, which is in the form of a claw, is a hole resealing portion. More specifically, as the toner supply container 1 is rotated in reverse to resealing the hole 7*b* of the toner receiving apparatus 7, the surface E of the portion 6*b* comes into contact with the apparatus shutter 8, and pushes it in the direction to pull up the apparatus shutter 8.

There is provided a gap B of a predetermined size, between the above-described claw-like portion 6*b* of the projection 6, and the peripheral surface of the container proper 1*a*. As force applies to the claw-like portion 6*b* from the direction indicated by an arrow mark C, the claw-like portion 6*b* elastically deforms toward the axial line of the container proper 1*a*, and as the force is removed, it is restored to its original shape. In other words, the projection 6 is enabled to snap into, or out of, the corresponding hole of the apparatus shutter 8. The direction in which the claw-like portion deforms is not limited to "toward the axial line of the container proper 1*a*". For example, it may be the direction parallel with the axial line of the container proper 1*a*.

Figure 12:
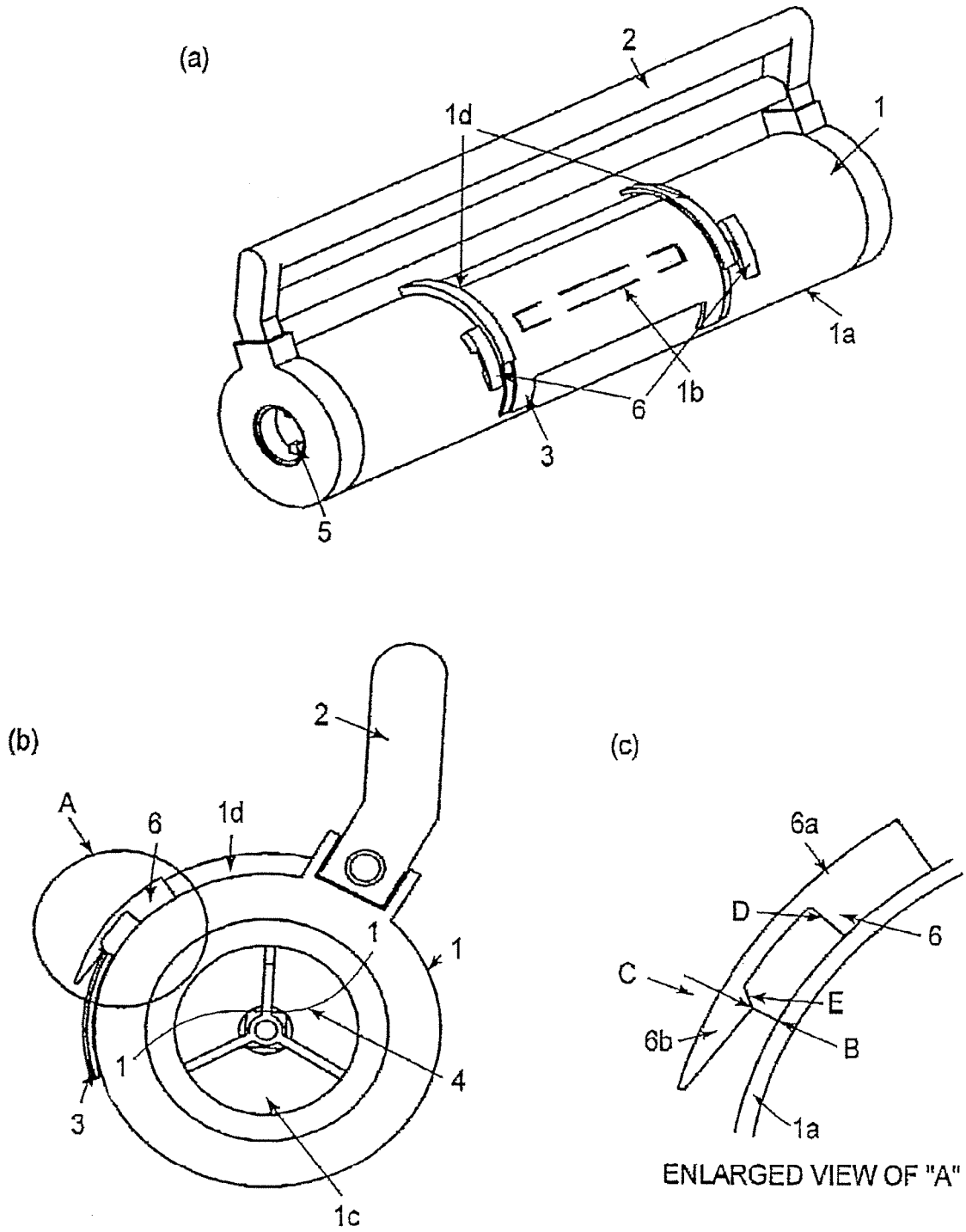
FIGS. 12(*a*) and 12(*b*) are perspective and sectional views of another toner supply container in accordance with the present invention, and FIG. 12(*c*) is an enlarged view of the portion of FIG. 12(*b*) indicated by an arrow mark A in FIG. 12(*b*).

The shutter movement regulating connective portions of the toner supply container 1 and toner receiving apparatus 7 may be structured as shown in FIGS. 12(*a*)-12(*b*). More specifically, the direction in which the protrusion, or the snap-fitting structure, of the claw-like portion 6*b*, faces, may be opposite to the direction in which the protrusion of the claw-like portion 6*b* faces in FIG. 2. Such modification creates no problem in terms of the functionality of the claw-like portion 6*b* of the projection 6. When the projection 6 is structured as shown in FIGS. 12(*a*)-12(*b*), the portion of the apparatus shutter 8, which engages with the claw-like portion 6*b*, must be configured so that it accommodates the claw-like portion 6*b*.

The shutter movement regulating connective portions may be different in structure from that in this embodiment and its modification described above. In other words, the connective portions may be modified in configuration, measurements, etc., as long as they can satisfy the requirement that they reliably push down the apparatus shutter 8 to unseal the toner receiving hole 7*b* of the toner receiving apparatus 7, and reliably pull up the apparatus shutter 8 to reseal the toner receiving hole 7*b*.

Since the connective portions are structured to snap-fit, not only is the apparatus shutter 8 reliably pulled up to reseal the apparatus shutter 8, but also, the apparatus shutter 8 can be easily disengaged from the pair of projections 6 after the resealing of the toner receiving hole 7*b* by the apparatus shutter 8.

It is desired that the projections 6 are formed, as integral parts of the container proper la, of resinous substance such as plastic by injection molding. However, it may be formed of material other than resinous substance, and formed by a method other than injection molding. Further, they may be made up of two or more pieces, which are joined. As described above, the claw-like portion 6*a* of the projection 6 is required to have a proper amount of resiliency, since it is required to temporarily deform when engaging with the apparatus shutter 8. Thus, low density polyethylene is the most desirable substance as the material for the claw-like portion 6*b*. Next in order of preference are polypropylene, linear polyamide (for example, Nylon (commercial name)), high density polyethylene, or the like.

Next, referring to FIGS. 3(*a*)-3(*c*), the toner receiving apparatus 7 as a developer receiving apparatus in this embodiment will be described regarding its structure.

The toner receiving apparatus 7 is provided with a toner supply container cradle 7*a* in which the toner supply container 1 is removably mounted, and a toner reception hole 7*b* as a toner inlet through which the toner discharged from the toner supply container 1 is moved into the main assembly (unshown) of the image forming apparatus.

The toner receiving apparatus 7 is also provided with the shutter 8 for unsealing or resealing the toner reception hole 7*b*. The apparatus shutter 8 is in the form of a semicylinder, the curvature of which matches that of the cylindrical wall of the toner supply container 1, and that of the wall of the toner supply container cradle 7*a* of the main assembly. The apparatus main shutter 8 is engaged with the pair of guiding members 7*c* located at the lengthwise edges of the rectangular toner reception hole 7*b*, on the underside of the semicylindrical top wall of the toner supply container cradle 7*a*. With the provision of this structural arrangement, the apparatus shutter 8 is allowed to slide along the semicylindrical top wall of the toner supply container cradle 7*a* along the curvature of the top wall, to open or close the toner reception hole 7*b*.

Figure 3:
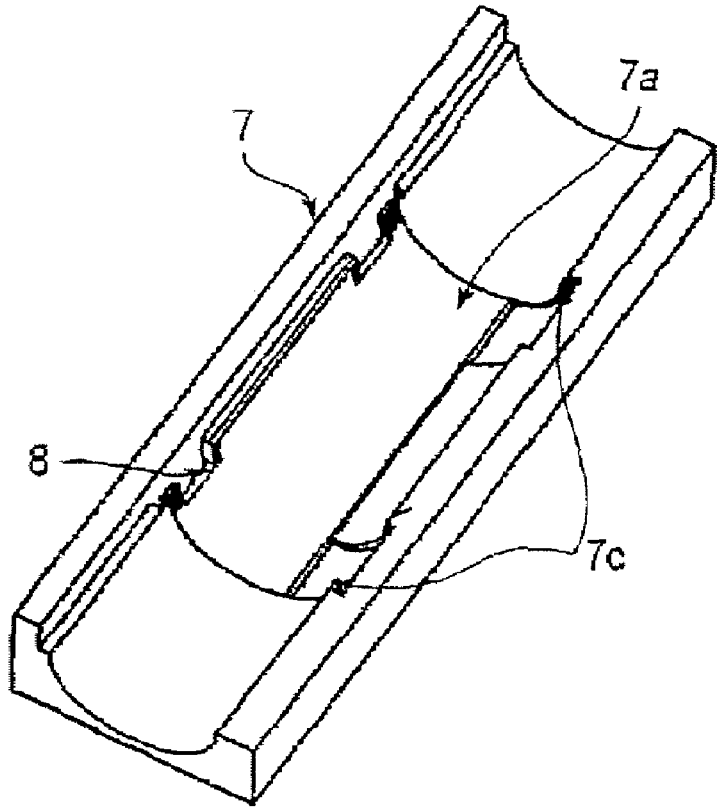
FIGS. 3(*a*), 3(*b*), and 3(*c*) are perspective views of the toner receiving apparatus in the first embodiment of the present invention, showing the toner receiving apparatus with its toner inlet closed, open, and closed again, respectively.
Figure 3:
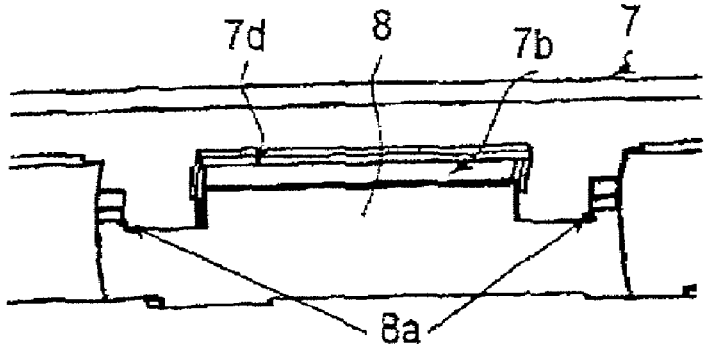
Figure 3:
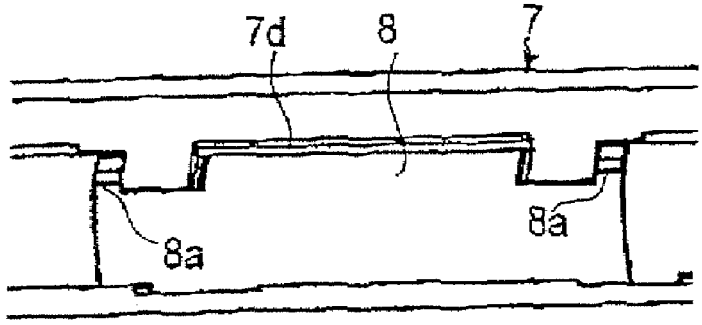

When the toner supply container 1 is not in the toner supply container cradle 7*a* of the toner receiving apparatus 7, the apparatus shutter 8 is in the position, shown in FIG. 3(*c*), in which the edge of the apparatus shutter 8 is in contact with the stopper 7*d* of the toner receiving apparatus 7, keeping thereby the toner supplying hole 7*b* of the toner receiving apparatus 7 closed, and therefore, preventing the toner from moving back into the toner supply container cradle 7*a* from inside the main assembly of the image forming apparatus.

The apparatus shutter 8 is also provided with a pair of projections 8*a* which engage with the pair of projections 6 of the toner supply container 1, during the operation for mounting the toner supply container 1 into the main assembly.

Next, referring to FIGS. 4(*a*) and 4(*b*) and FIGS. 5(*a*)-5(*c*), the operation for supplying the main assembly of the image forming apparatus with toner, with the use of the toner supply container 1 and toner receiving apparatus 7 in the first embodiment, will be described.

First, the toner supply container 1 is to be mounted into the toner receiving apparatus 7 from the direction indicated by an arrow mark F. When the toner supply container 1 is mounted, it is to be positioned so that the toner discharge hole 1*b* covered with the shutter 3, or the shutter on the toner supply container side, faces upward; in other words, the toner discharge hole 1*b* is not in alignment with the toner reception hole 7*b* sealed with the apparatus shutter 8.

Figure 4:
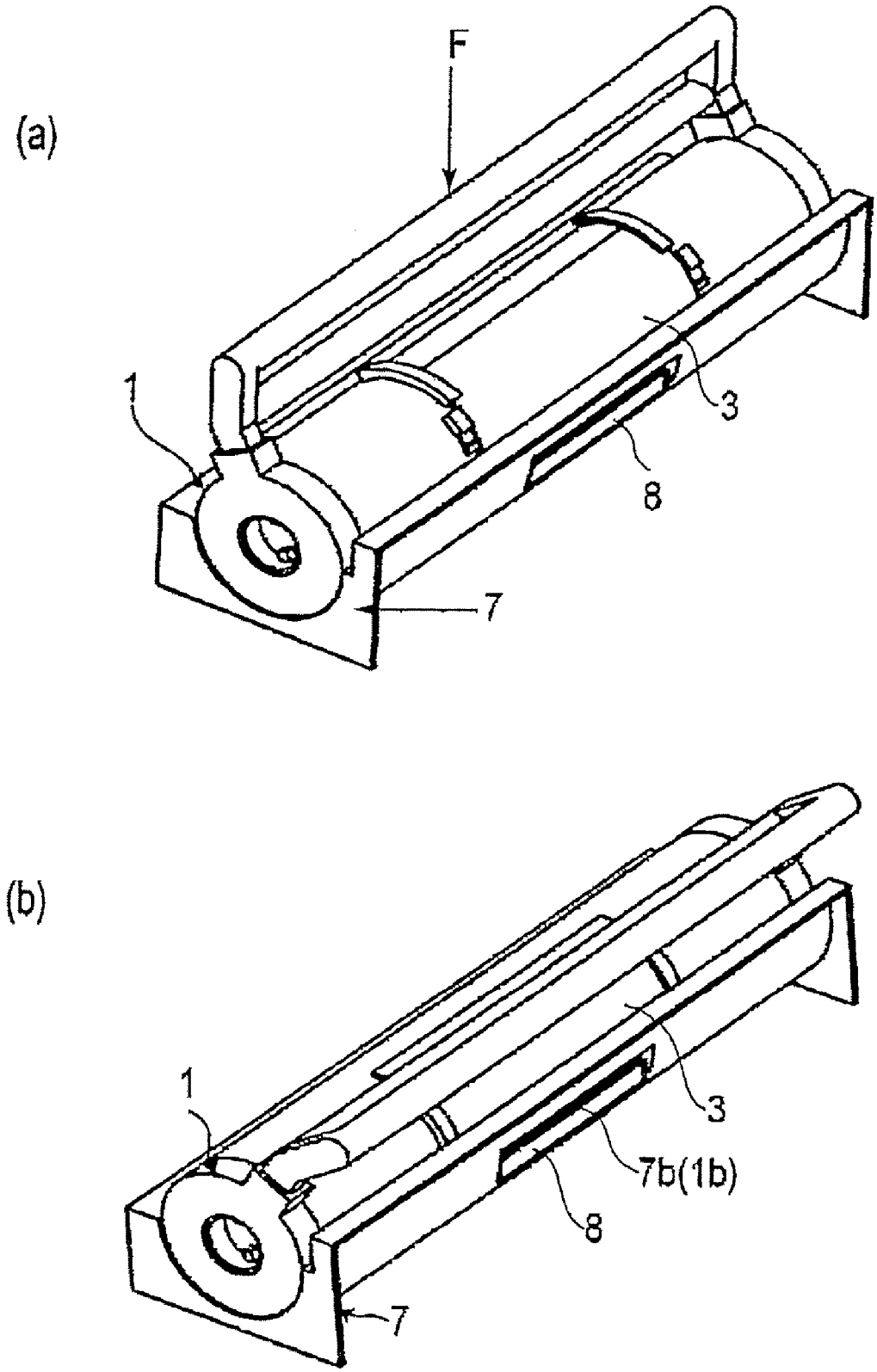
FIGS. 4(*a*) and 4(*b*) are perspective views of the toner supply container in the first embodiment of the present invention, showing the state of the toner supply container immediately after the mounting of the container into the toner receiving apparatus, and after the rotation of the toner supply container by its handle after the mounting of the toner supply container into the toner receiving apparatus, respectively.

The toner supply container 1 is structured so that as soon as the bottom edge (leading edge in terms of direction in which the toner supply container 1 is moved to unseal toner discharge hole 1*b*) of the shutter 3 roughly aligns (inclusive of tolerance in measurements of toner supply container 1 and toner receiving apparatus 7, and play) with the top edge of the toner reception hole 7*b*, the shutter 3 is prevented by the stopper 7*d* from moving with the container proper 1*a* in the circumferential direction of the container proper 1*a* (FIGS. 4(*a*), 5(*a*), and 5(*a*')).

Next, a user rotates the toner supply container 1 in the counterclockwise direction (first direction), as seen from the direction of the toner filling hole 1*c* (FIG. 5), by grasping the handle 2. Initially, as the toner supply container 1 is rotated in the first direction, the shutter 3 of the toner supply container 1 rotates with the container proper 1*a* of the toner supply container 1. Then, it comes into contact with the aforementioned stopper 7*d* of the toner receiving apparatus 7, being prevented from rotating with the container proper 1*a*.

Thus, as the toner supply container 1 is further rotated in the first direction, the bottom edge (leading edge portion in terms of direction in which toner supply container 1 is moved to unseal toner discharge hole 1*b*) of the toner discharge hole 1*b* is exposed from the bottom side of the shutter 3. Roughly at the same time as the bottom edge portion of the toner discharge hole 1*b* is exposed from the bottom side of the shutter 3, the bottom edge of the shutter 3 (leading edge portion in terms of direction in which toner supply container 1 is moved to unseal toner discharge hole 1*b*) roughly aligns with the top edge portion (trailing edge portion, no more than 2 mm wide from upstream edge, of apparatus shutter 8 in terms of direction in which toner supply container 1 is rotated) (FIGS. 5(*b*) and 5(*b*')), and the claw-like portion 6*b* of each projection 6 is elastically deformed, engaging thereby with the catch 8*a* of the apparatus shutter 8.

Then, as the toner supply container 1 is further rotated in the same direction, the apparatus shutter 8 is rotated with the toner supply container 1 by being pushed by portion 6*a* of the projection 6, while the top edge portion (trailing edge portion, no more than 2 mm wide from trailing edge, of shutter 8 in terms of rotational direction of toner supply container) is remaining overlapped with the bottom edge portion of the toner discharge hole 1*b* (leading edge portion, no more than 2 mm wide from leading edge, of toner discharge hole 1*b* in terms of rotational direction of toner supply container 1). As a result, the toner reception hole 7*b* is exposed (unsealed), and therefore, the toner reception hole 7*b* becomes connected with the toner discharge hole 1*b*. Then, as the toner reception hole 7*b* is entirely exposed, that is, the toner reception hole 7*b* is fully connected with the toner discharge hole 1*b*, the toner supply container 1 comes into contact with the stopper of the toner receiving apparatus 7, being thereby prevented from being further rotated (FIGS. 4(*b*) and 5(*c*)).

As the toner reception hole 7*b* and toner discharge hole 1*b* becomes fully connected, rotational driving force is transmitted to the stirring member 4 from the driving mechanism on the main assembly side of the image forming apparatus, through the coupling member 5 of the toner supply container 1, which has coupled with the driving mechanism on the main assembly side. As a result, toner is supplied from the toner supply container 1 to the toner receiving apparatus 7.

Figure 5:
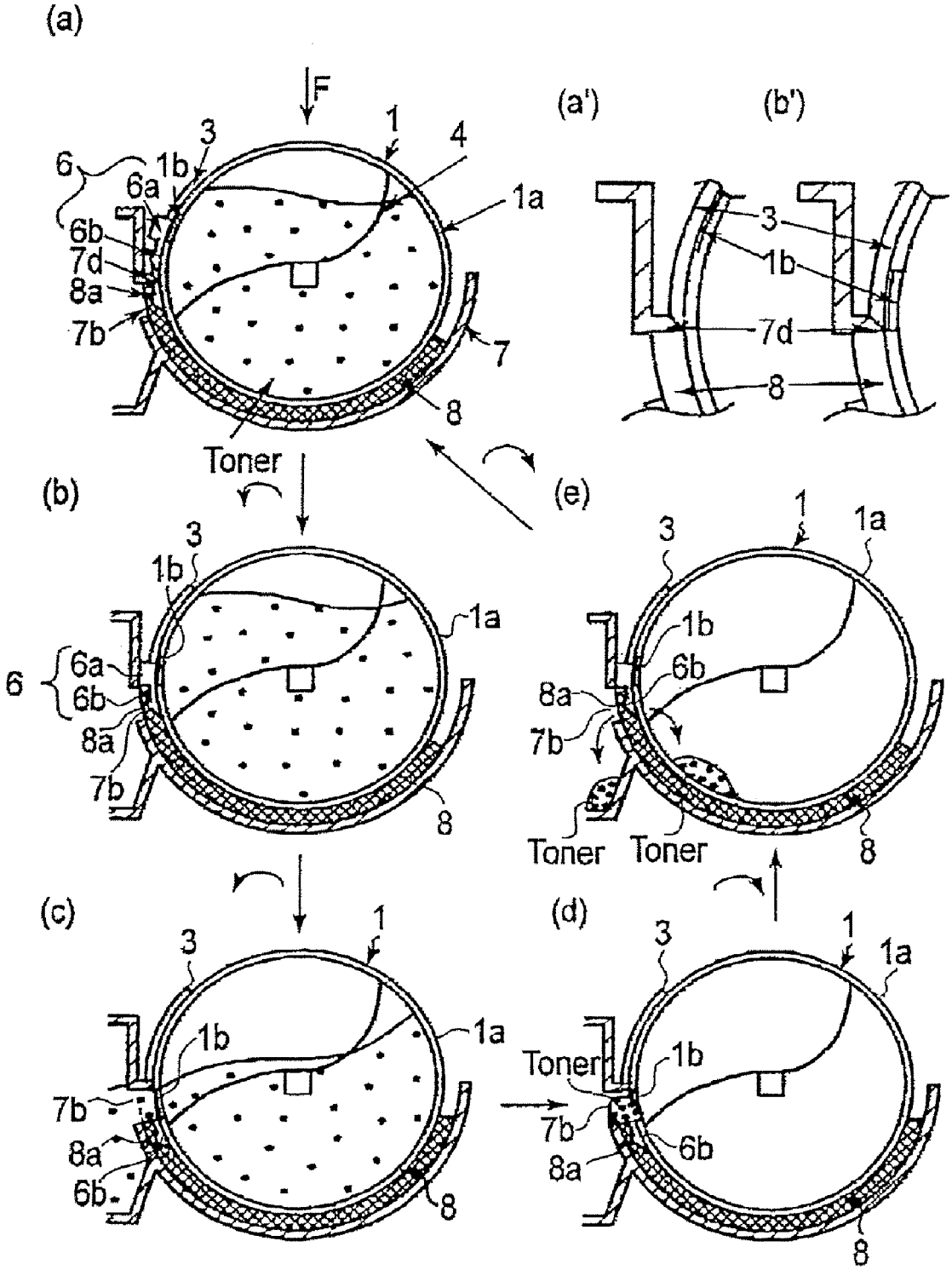
FIGS. 5(*a*)-5(*e*) are sectional views of the toner supply container, and the toner receiving apparatus in which the toner supply contain is present, during the toner discharge, FIG. 5(*a*) showing the states of the toner supply container and toner receiving apparatus immediately after the mounting of the former into the latter, FIG. 5(*a*') being an enlarged view of the toner outlet and its adjacencies, FIG. 5(*b*) showing the states of the toner supply container and toner receiving apparatus during the rotation of the toner supply container, FIG. 5(*b*') being an enlarged view of the toner outlet and its adjacencies, FIG. 5(*c*) showing the states of the toner supply container and toner receiving apparatus during the toner discharge, FIG. 5(*d*) showing the states of the container and apparatus after the completion of the toner discharge, and FIG. 5(*e*) showing the states of the container and apparatus during the rotation of the container after the completion of the toner discharge.
Figure 6:
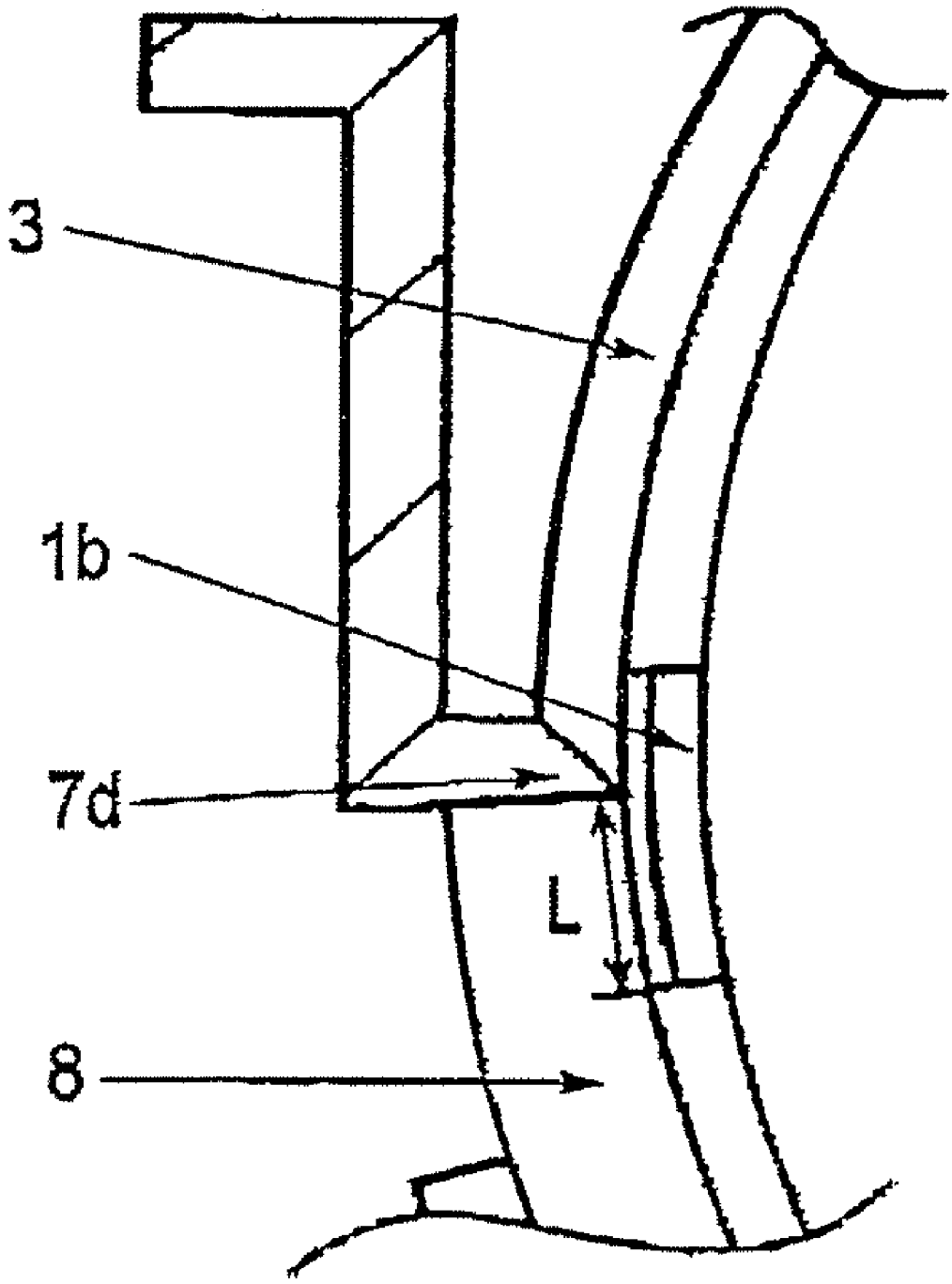
FIG. 6 is a sectional view of the toner outlet of the toner supply container, and its adjacencies, in the first embodiment of the present invention, showing the state of the toner supply container, in which the bottom edge of the toner discharge hole 1*b* of the toner supply container has not aligned with the top edge of the apparatus shutter 8, that is, the shutter on the main assembly side of the image forming apparatus.

After the completion of the toner discharge from the toner supply container 1, there is a certain amount of toner, across the bottom edge of the toner reception hole 7*b*, which has accumulated thereon during the toner discharge (FIG. 5(*d*)).

Next, the user rotates the toner supply container 1 in the clockwise direction (FIG. 5) as the second rotational direction, as seen from the direction of the toner filling hole 1*c*, in terms of the axial direction of the toner supply container 1, by grasping the handle 2, with the certain amount of toner still remaining across the bottom edge of the toner reception 7*b* as described above. As the toner supply container 1 is reversely rotated, that is, in the clockwise direction, the apparatus shutter 8 is pulled upward by the pair of projections 6 of the container proper 1*a*, because each of the pair of catch portions 8*a* of the apparatus shutter 8 is remaining engaged with claw-like portion 6*a* of the corresponding projection 6 of the toner supply container 1. As a result, the apparatus shutter 8 is rotated with the toner supply container 1, with the top edge portion of the apparatus shutter 8 (leading edge portion, no more than 2 mm wide, of shutter 8 in terms of direction in which toner supply container 1 is rotated to reseal toner reception hole 7*b*) remaining overlapped the bottom edge portion (trailing edge portion, no more than 2 mm wide from trailing edge, of toner discharge hole 1*b* in terms of direction in which toner supply container 1 is rotated to reseal toner discharge hole 1*b*) of the toner discharge hole 1*b*.

During this reverse rotation of the toner supply container 1, the top edge portion of the apparatus shutter 8 (leading edge portion, not more than 2 mm wide from leading edge, of shutter 8, in terms of direction in which toner supply container 1 is rotated to reseal toner reception hole 7*b*), and the bottom edge portion of the toner discharge hole 1*b* (trailing edge portion, no more than 2 mm wide from trailing edge, of toner discharge hole 1*b*, in terms of direction in which toner supply container 1 is rotated to reseal toner discharge hole 1*b*), passes, while remaining overlapped with each other, between the toner reception hole 7*b* and toner discharge hole 1*b* which are in connection with each other.

Also during this reverse rotation of the toner supply container 1, the aforementioned certain amount of the toner having accumulated across the bottom edge portion of the toner reception hole 7*b* is recovered into the toner receiving apparatus 7 through the toner reception hole 7*b*, and also into the container proper 1*a* through the toner discharge hole 1*b*, as the toner supply container 1 is rotated to be resealed (FIG. 5(*e*)), drastically reducing the amount by which the toner supply container 1 is contaminated by the aforementioned accumulated toner.

With the employment of the above-described structural arrangement, it is possible to prevent the hand(s) of a user from being contaminated when the user removes the toner supply container 1 from the main assembly of the image forming apparatus. Therefore, it is possible to improve the toner supply container 1 as well as the image forming apparatus, in terms of usability.

Further, as the toner supply container 1 is rotated to be resealed, the rotational movements of the apparatus shutter 8 and toner supply container shutter 3 are controlled by the pair of projections 6 of the toner supply container 1 in such a manner that the top edge portion of the apparatus shutter 8 (leading edge portion, no more than 2 mm wide from leading edge, of shutter 8 in terms of direction in which toner supply container 1 is rotated to reseal toner discharge hole 1*b*) comes into contact with the bottom surface of the stopper 7*d* of the toner receiving apparatus 7, preventing thereby the apparatus shutter 8 from rotating further with the toner supply container 1. As a result, not only is the toner reception hole 7*b* completely closed by the apparatus shutter 8, but also, the top edge portion of the toner discharge hole 1*b* (leading edge portion, no more than 2 mm wide from leading edge, of toner discharge hole l*b* in terms of direction in which toner supply container 1 is rotated to reseal toner discharge hole 1*b*) begins to be covered by the shutter 3 roughly at the same time as the apparatus shutter 8 completely closes the toner reception hole 7*b*.

As the toner supply container 1 is rotated further, the claw-like portion 6*b* of each of the pair of projections 6 is disengaged from the corresponding catch 8*a* of the apparatus shutter 8, while elastically deforming in the direction to allow itself to be disengaged from the catch 8*a*, because the apparatus shutter 8 is prevented by the stopper 7*d* from rotating further. In other words, the pair of projections 6 of the toner supply container 1 become disengaged from the pair of catches 8*a* of the apparatus shutter 8. Thereafter, the toner supply container 1 is to be further rotated, and during this rotation, the toner discharge hole 1*b* is completely shut by the toner supply container shutter 3, which is being prevented by the toner receiving apparatus 7 from rotating with the toner supply container 1. As soon as the toner discharge hole 1*b* is completely shut by the shutter 3, the stopper (projection) on the peripheral surface of the container proper 1*a* of the toner supply container 1 comes into contact with the toner receiving apparatus 7, preventing the toner supply container 1 from being rotated further, in other words, restoring the toner supply container 1 to the state shown in FIG. 5(*a*).

Lastly, the user pulls the toner supply container 1 out of the toner receiving apparatus 7 to complete the operation for supplying the main assembly of the image forming apparatus with toner, inclusive of the above-described sequence for resealing the toner supply container 1 (toner discharge hole 1*b*).

Figure 13A:
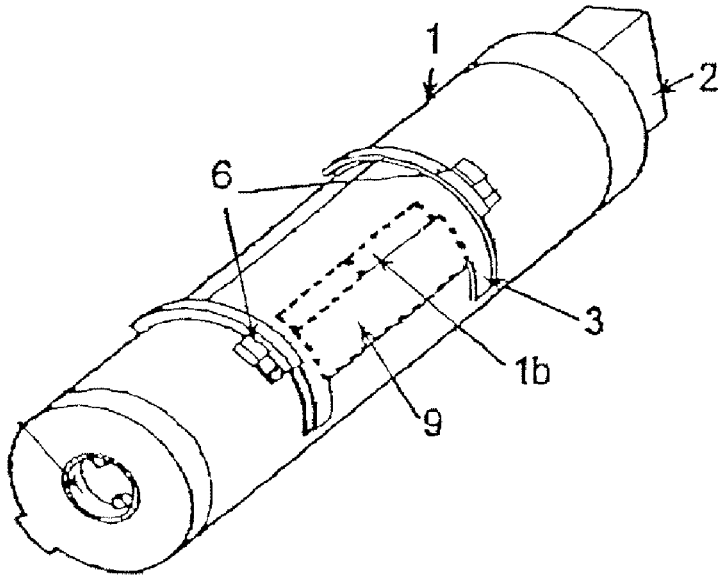
FIG. 13 is a perspective view of a toner supply container (a) and a perspective view of a toner receiving device (b) according to a further embodiment.
Figure 13B:
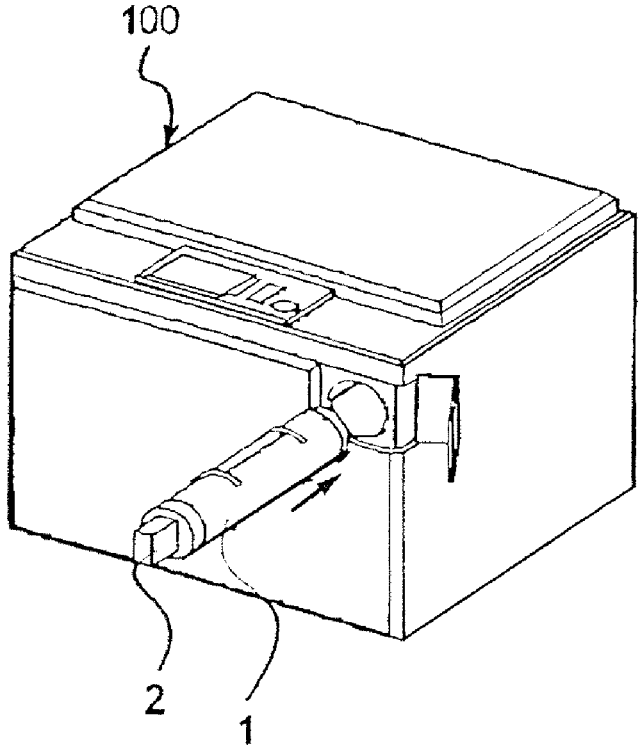

In this embodiment, the direction from which the toner supply container 1 is mounted into the toner receiving apparatus 7 is from above (direction indicated by arrow mark F in FIG. 4(*a*). However, it does not need to be limited to this direction. For example, the toner supply container 1 and toner receiving apparatus 7 may be structured as disclosed in Japanese Laid-open Patent Applications 7-199623 or 7-44000, for example, so that the toner supply container 1 is mounted from the front side of the main assembly. More specifically, the toner supply container 1 is horizontally mounted into, or removed from, the toner receiving apparatus 7, in the direction parallel with the lengthwise direction of the toner supply container 1, as shown in FIG. 13.

Also in this embodiment, the toner supply container 1, and the main assembly of the image forming apparatus, are structured so that the toner discharge hole 1*b* becomes connected to the toner reception hole 7*b* as the toner supply container 1 is rotated enough to cause the toner discharge hole 1*b* to face in the horizontal direction. However, they do not need to be structured in this manner.

Further, the direction in which the toner supply container 1 is rotated to be prepared for toner discharge does not need to be limited to the direction in which the toner supply container 1 is rotated in this embodiment. For example, the toner supply container 1 and the main assembly of the image forming apparatus may be structured so that the toner supply container 1 is to be mounted, with the toner discharge hole 1*b* facing downward, and so that in order to unseal the toner supply container 1, the toner supply container 1 is rotated in the direction opposite to the direction in which the toner supply container 1 in the above-described embodiment is rotated to unseal the toner supply container 1, whereas in order to reseal the toner supply container 1, the toner supply container 1 is rotated in the direction opposite to the direction in which the toner supply container 1 in the above-described embodiment is rotated to reseal the toner supply container 1.

When the toner supply container 1 structured as described above was filled up with toner, was mounted into the toner receiving apparatus 7, and was removed from the toner receiving apparatus 7 after the completion of toner discharge, there was virtually no confirmable contamination of the toner supply container 1 and toner receiving apparatus 7 by toner.

The above-described states of the toner supply container 1 and toner receiving apparatus 7, in which the bottom edge portion of the toner discharge hole l*b* and the top edge portion of the apparatus shutter 8 overlap with each other in terms of the rotational direction of the apparatus shutter 8, means the states of the toner supply container 1 and toner receiving apparatus 7, in which the deviation (L) between the bottom edge of the toner discharge hole l*b* and the top edge of the apparatus shutter 8, in terms of the rotational direction of the toner supply container 1 is no more than roughly 5 mm. According to the levels of the contamination by toner, confirmed after the completion of the operation for supplying the main assembly of the image forming apparatus with toner, as long as the deviation (L) is no more than roughly 5 mm, the level of the contamination by toner is not problematic, that is, no worse than that when the deviation (L) was zero (state shown in FIG. 5).

In other words, this embodiment ensures that during the operation for supplying the main assembly of an image forming apparatus with toner, the shutter on the main assembly side, and the shutter on the toner supply container side, reliably and easily open or shut after the mounting of the toner supply container 1 into the toner receiving apparatus 7, and also, minimizes the contamination of the toner supply container 1 by toner.

Embodiment 2

Figure 7:
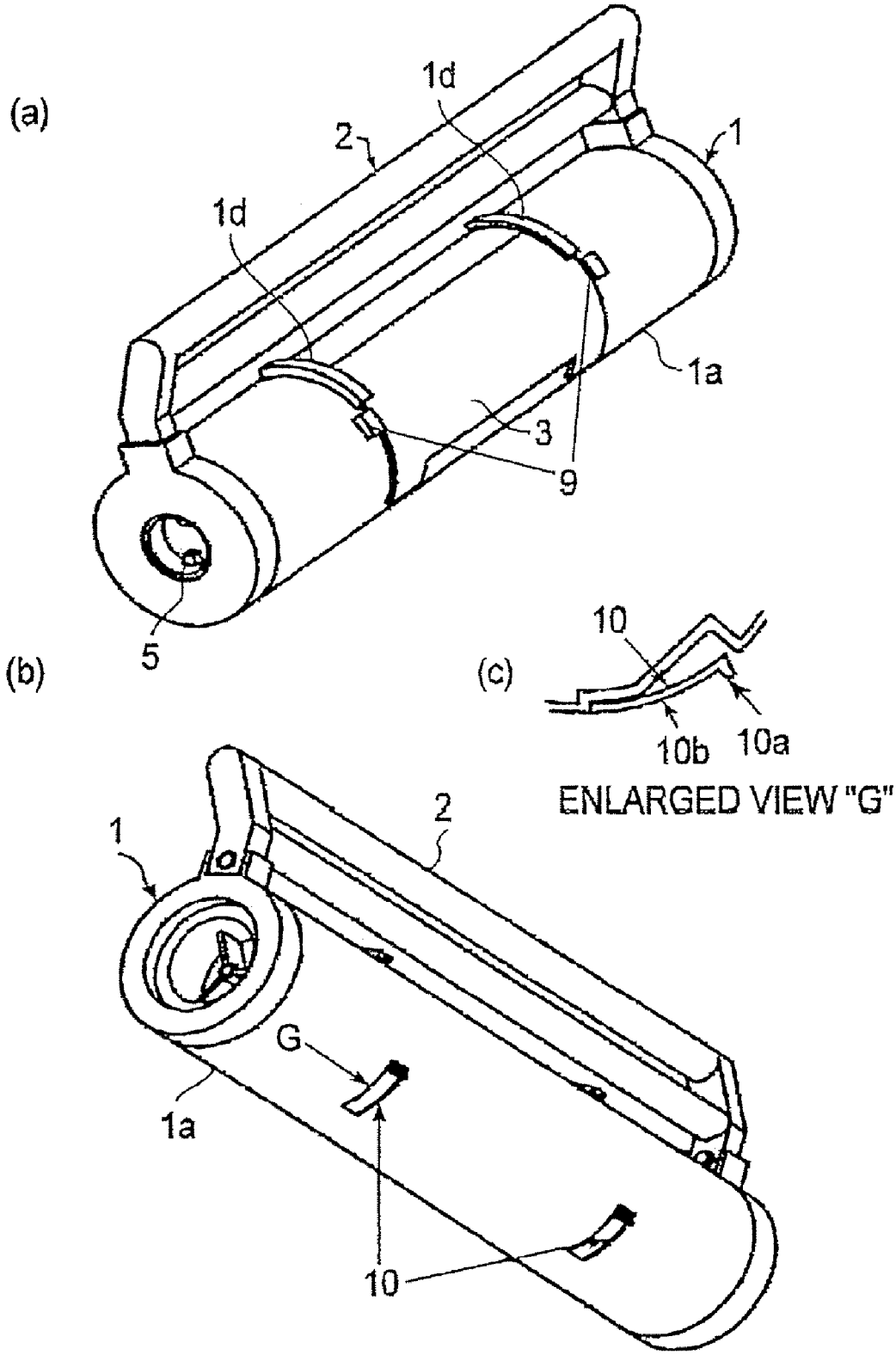
FIGS. 7(*a*) and 7(*b*) are perspective views of the toner supply container in the first embodiment of the present invention, as seen from diagonally above, and below, respectively, one of the lengthwise ends of the container, and FIG. 7(*c*) is a sectional view of the container, at the plane indicated by an arrow mark G in FIG. 7(*b*).

Next, referring to FIGS. 7(*a*)-(*c*), the structure of the toner supply container 1 in the second embodiment of the present invention will be described.

In the above-described first embodiment of the present invention, the portion 6*a*, as the portion for opening the apparatus shutter 8, and the claw-like portion 6*b*, as the portion for closing the apparatus shutter 8, of the projection 6 as the shutter movement regulating portion of the container proper 1*a*, are integral parts of the projection 6. In this embodiment, the portion of the container proper 1*a* for opening the apparatus shutter 8, and the portion of the container proper 1*a* for closing the apparatus shutter 8, are made independent from each other, although they both project from the peripheral surface of the container proper 1*a* of the toner supply container 1.

More specifically, the toner supply container 1 is provided with a projection 9 as the portion for pushing down the apparatus shutter 8 to unseal the toner reception hole 7*b* of the toner receiving apparatus 7 as the toner supply container 1 is rotated after the mounting of the toner supply container 1 into the toner receiving apparatus 7 to supply the apparatus main assembly with toner. The projection 9 projects from the peripheral surface of the container proper 1*a* of the toner supply container 1.

The toner supply container 1 is also provided with a shutter hooking projection 10 as the portion for hooking the apparatus shutter 8 to pull up the apparatus shutter 8 in order to reseal the toner reception hole 7*b*. The hooking projection 10 projects from the peripheral surface of the container proper 1*a* of the toner supply container 1. It comprises the hooking portion 10*a* and an elastic portion 10*b*. The hooking portion 10 projects from the tip of the elastic portion 10*b* in the radius direction of the container proper 1*a*, beyond the peripheral surface of the container proper 1*a*. The elastic portion 10*b* elastically deforms toward the axial line of the container proper 1*a*. In this embodiment, the combination of the pushing projections 9 as the container unsealing portions, and shutter hooking projection 10, play the role of regulating the shutter movement, which is played by the pair of projections 6 of the toner supply container 1 in the first embodiment.

The structures of the other portions of the toner supply container 1 than the above-described portions, and the structure of the toner receiving apparatus 7, are the same as those in the first embodiment, and therefore, will not be described.

Next, referring to FIGS. 8(*a*)-(*e*), the operation for supplying the main assembly of the image forming apparatus with toner, with the use of the toner supply container 1 and toner receiving apparatus 7 in the second embodiment of the present invention, will be described.

First, the toner supply container 1 is to be mounted into the toner receiving apparatus 7 from the direction indicated by an arrow mark F. As the toner supply container 1 is inserted into the toner receiving apparatus 7, the hooking portion 10*a* of the hooking projection 10 is pressed against the upwardly facing surface of the apparatus shutter 8, causing the elastic portion 10*b* to be elastically deformed. As a result, the entirety of the hooking projection 10 is caused to retract into the recess of the cylindrical wall of the container proper 1*a* (FIG. 8(*a*)).

Next, a user rotates the toner supply container 1 in the counterclockwise direction, as seen from the direction of the toner filling hole 1*c*, by grasping the handle 2. As the toner supply container 1 is rotated, it is moved relative to the toner supply container shutter 3, the movement of which is regulated by the toner receiving apparatus 7.

As the toner supply container 1 is further rotated, the bottom edge of the toner discharge hole 1*b* roughly aligns with the bottom edge of the shutter 3 (FIG. 5(*b*')). Roughly at the same time as the bottom edge of the toner discharge hole 1*b* aligns with the bottom edge of the shutter 3, the pair of projections 9 of the toner supply container 1 come into contact with the edge of the apparatus shutter 8, and the hooking projection 10 is freed from the pressure applied thereto by the upwardly facing surface of the apparatus shutter 8 in the radius direction of the container proper 1*a*. As a result, the elastic portion 10*b* of the hooking projection 10 resumes its original shape, causing the hooking portion 10*a* of the hooking projection 10 to hook the apparatus shutter 8 by the edge of the apparatus shutter 8 (FIG. 8(*b*)).

Then, as the toner supply container 1 is further rotated, the apparatus shutter 8 is moved (rotated) with the toner supply container 1 by being pushed by the projections 9. As a result, the toner reception hole 7*b* of the toner receiving apparatus 7 becomes connected with the toner discharge hole 1*b* of the toner supply container 1 (FIG. 8(*c*)). As the two holes 7*b* and 1*b* become connected with each other, it becomes possible for rotational driving force to be transmitted from the driving mechanism on the main assembly side of the image forming apparatus to the stirring member 4 through the gear 5. Therefore it becomes possible for toner to be supplied from the toner supply container 1 to the toner receiving apparatus 7.

Figure 8:
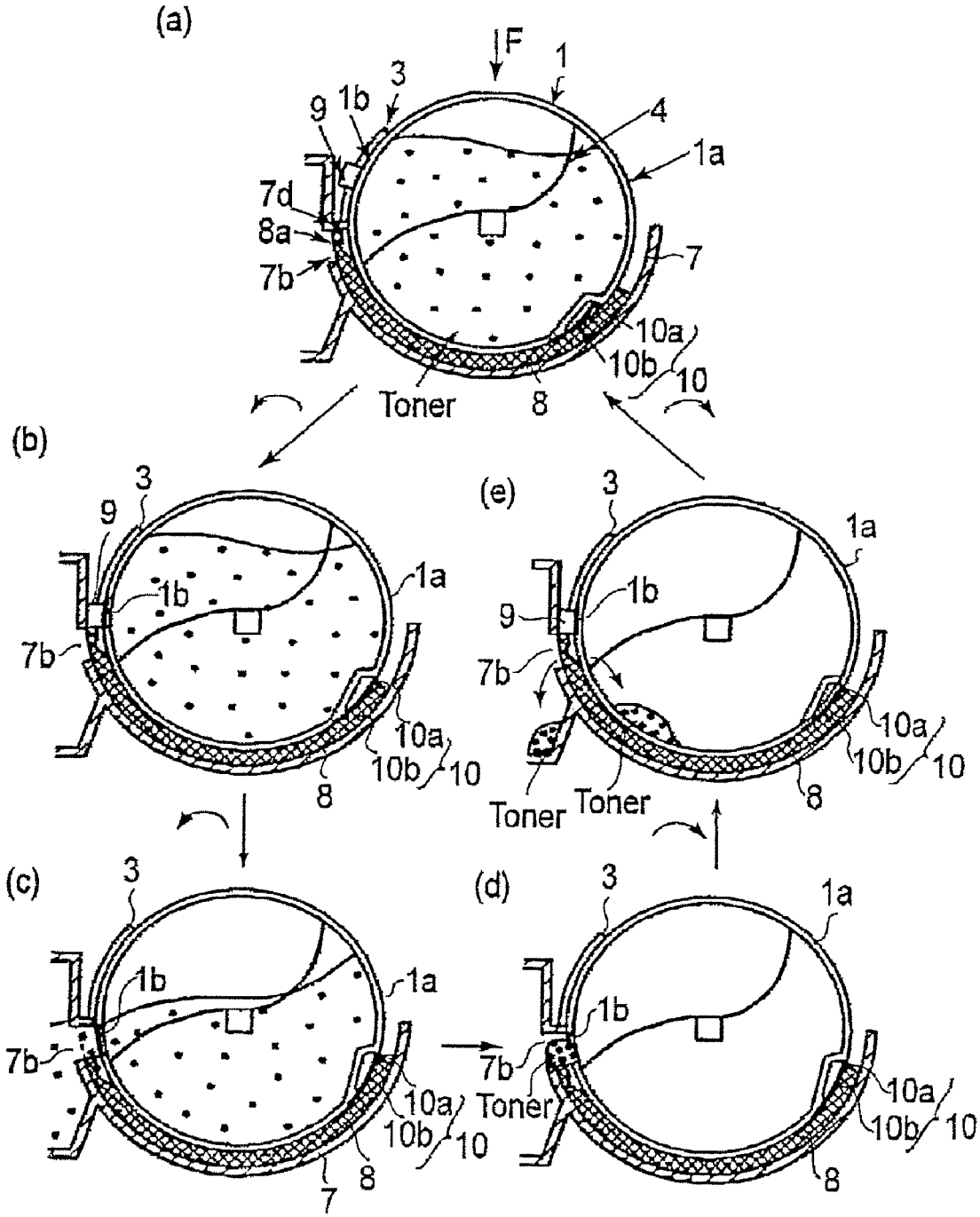
FIGS. 8(*a*)-8(*e*) are sectional views of the toner supply container, and the toner receiving apparatus in which the toner supply container is present, during the toner discharge, FIG. 8(*a*) showing the states of the toner supply container and toner receiving apparatus immediately after the mounting of the former into the latter, FIG. 8(*b*) showing the states of the toner supply container and toner receiving apparatus during the rotation of the toner supply container, FIG. 8(*c*) showing the states of the toner supply container and toner receiving apparatus during the toner discharge, FIG. 8(*d*) showing the states of the container and apparatus after the completion of the toner discharge, and FIG. 8(*e*) showing the states of the container and apparatus during the rotation of the container after the completion of the toner discharge.

After the operation for supplying the main assembly of the image forming apparatus with toner is completed, there is a certain amount of toner, across bottom edge of the toner reception hole 7*b*, which has accumulated thereon during the toner discharge (FIG. 8(*d*)).

Next, the user rotates the handle 2 in the opposite direction, that is, the clockwise direction, as seen from the direction of the toner filling hole 1*c*, in terms of the axial direction of the toner supply container 1, with the certain amount of toner still remaining across the bottom edge of the toner reception 7*b* as described above. As the handle 2 is reversely rotated, that is, in the clockwise direction, the apparatus shutter 8 is moved (rotated) with the toner supply container 1, because each of the pair of hooking portions 10*a* are remaining hooked on the edge of the apparatus shutter 8. As a result, the toner reception hole 7*b* is sealed. Also during this reverse rotation of the toner supply container 1, the aforementioned certain amount of the toner having accumulated across the bottom edge portion of the toner reception hole 7*b* is recovered into the main assembly of the image forming apparatus and/or the container proper 1*a* (FIG. 8(*e*)).

As the toner supply container 1 is further rotated, the hooking portion 10*b* of the hooking projection 10 is made to elastically deform radially inward of the container proper 1*a*, because the apparatus shutter 8 is regulated by the stopper 7*d*, being therefore prevented from rotating further. As a result, not only is the hooking portion 10*a* of the hooking projection 10 caused to disengage from the edge of the apparatus shutter 8, but also, to come into contact with the surface of the apparatus shutter 8, being thereby pressed by the surface of the apparatus shutter 8 so that it completely retracts into the recess of the cylindrical wall of the container proper 1*a*. In other words, the toner supply container 1 becomes disengaged from the apparatus shutter 8, being thereby allowed to rotate independently from the apparatus shutter 8 to be eventually restored to the state shown in FIG. 8(*a*). Lastly, the user pulls the toner supply container 1 out of the toner receiving apparatus 7 to complete the operation (sequential steps) for supplying the main assembly of the image forming apparatus with toner.

When the toner supply container 1 structured as described above was filled up with toner, was mounted into the toner receiving apparatus 7, and was removed from the toner receiving apparatus 7 after the completion of the toner discharge, there was virtually no confirmable contamination of the toner supply container 1 and toner receiving apparatus 7 by toner, as there was virtually none in the case of the toner supply container 1 in the first embodiment. In other words, this embodiment also ensures that during the operation for supplying the main assembly of an image forming apparatus with toner, the shutter on the main assembly side, and the shutter on the toner supply container side, reliably and easily open or shut after the mounting of the toner supply container 1 into the toner receiving apparatus 7, and also, minimizes the contamination by toner, after the removal of the toner supply container 1.

Next, the effects of the present invention will be further verified through the comparison of the toner supply container and toner receiving apparatus in the above-described embodiments of the present invention with those in the following comparative examples.

COMPARATIVE EXAMPLE 1

Figure 9:
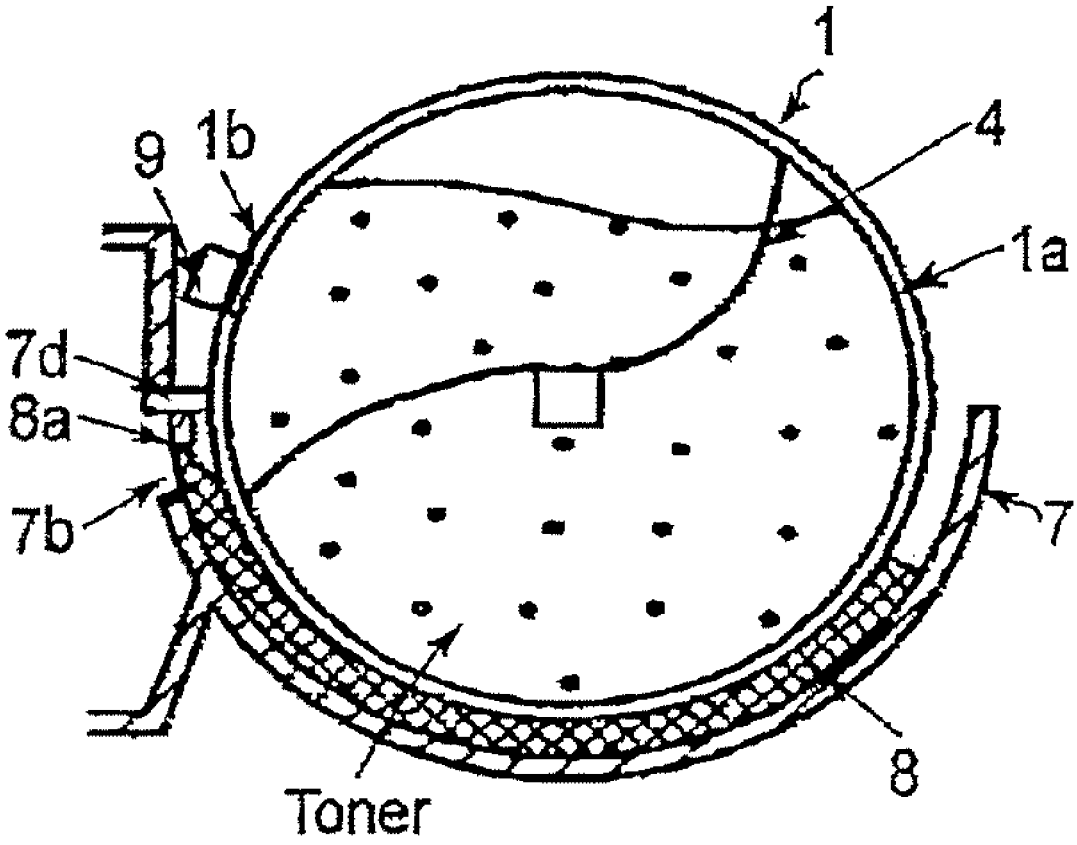
FIG. 9 is a sectional view of the toner supply container in the first comparative example, showing the state of the toner supply container immediately after the mounting of the container into the toner receiving apparatus during the toner supplying operation.

First, referring to FIG. 9, the structure of the toner supply container in the first comparative example, and the toner supplying operation which employs the toner supply container in the first comparative example, will be described.

In the case of the toner supply container 1 in the first comparative example, a pair of pushing projections 9 for pushing the apparatus shutter 8 of the main assembly to unseal the toner reception hole 7*b* during the toner supplying operation are located on the peripheral surface of the container proper 1*a* of the toner supply container 1 (in other words, the toner supply container 1 is not provided with the projections 6, with which the toner supply container 1 in the first embodiment is provided, nor the hooking projections 10, with which the toner supply container 1 in the second embodiment is not provided). Also in the case of the toner supply container 1 in the first comparative example is not provided with a container shutter 3 such as those in the above-described first and second embodiments. Instead, the toner discharge hole 1*b* is sealed with a heat seal or the like, which is to be removed after the mounting of the toner supply container 1 into the main assembly of the image forming apparatus, to unseal the toner discharge hole 1*b* to carry out the toner supplying operation. The structures of the other portions of the toner supply container 1 than the above-described portion, and the structure of the toner receiving apparatus 7, are roughly the same as those in the first embodiment.

The toner supply container 1 structured as described above was filled up with toner, and then, was mounted in the toner receiving apparatus 7. Then, as it was rotated, the toner reception hole 7*b* was opened by the pushing projections 9, allowing the main assembly to be supplied with the toner from the toner supply container 1. However, the toner reception hole 7*b* could not be resealed with the apparatus shutter 8. Therefore, the toner having accumulated across the bottom edge portion of the toner reception hole 7*b* during the toner discharge was hardly recovered into the main assembly of the image forming apparatus and/or the container proper 1*a*, resulting in the severe contamination of the surfaces of the toner supply container 1 and toner receiving apparatus 7 with toner; it was possible to confirm the presence of a substantial amount of toner on the surfaces of the toner supply container 1 and toner receiving apparatus 7, after the removal of the toner supply container 1 from which toner had been discharged. Further, since the toner supply container 1 was not provided with a shutter, the contaminated portions of the toner supply container 1 were not covered.

In other words, the effectiveness of the shutter movement regulating portion (claw-like portion 6*b* of connective projection 6, hooking projection 10, etc., in the above-described embodiments) in accordance with the present invention were confirmed.

COMPARATIVE EXAMPLE 2

Next, referring to FIGS. 10(*a*)-10(*e*), the structure of the toner supply container 1 in the second comparative example, and the toner supplying operation, which employs the toner supply container 1 in the second comparative example, will be described.

The toner supply container 1 in the second comparative example is similar in structure to the toner supply container 1 in first comparative example, except for the pair of projections 11 with which it is provided. The projection 11 is for pushing the apparatus shutter 8 to reseal the toner reception hole 7*b* during the toner supplying operation. The projection 11 is positioned so that it will be on the downstream of the apparatus shutter 8 after the mounting of the toner supply container 1 into the toner receiving apparatus 7. The structures of the other portions of the toner supply container 1 than the projections 11, and the structure of the toner receiving apparatus 7, were the same as those in the first comparative example.

The toner supply container 1 structured as described above was subjected to the same tests as those the toner supply container 1 in the first comparative example was subjected. The results were as follows.

Figure 10:
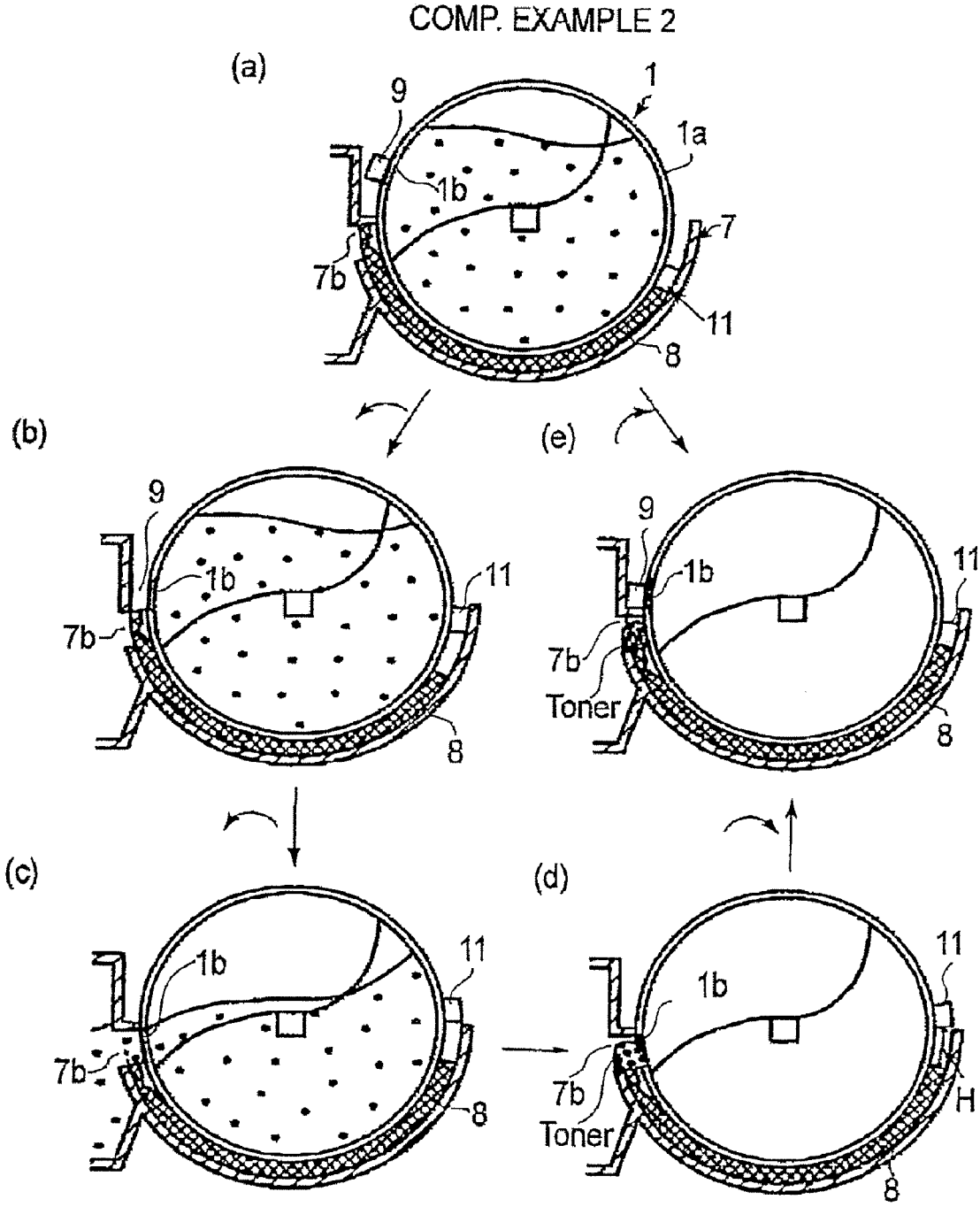
FIGS. 10(*a*)-10(*e*) are sectional views of the toner supply container, and the toner receiving apparatus in which the toner supply container is present, in the second comparative example, during the toner supplying operation, showing the states of the toner supply container and toner receiving apparatus immediately after the mounting of the former into the latter (FIG. 10(*a*)), during the rotation of the toner supply container (FIG. 10(*b*)), during the toner discharge (FIG. 10(*c*)), after the completion of the toner discharge (FIG. 10(*d*)), and during the rotation of the container after the completion of the toner discharge (FIG. 10(*e*)), respectively.

The apparatus shutter 8 was rotated by the pushing projections 9, and therefore, the toner reception hole 7*b* of the toner receiving apparatus 7 was unsealed, as it was in the first comparative example (FIGS. 10(*b*)-10(*c*). However, there remained a deviation H between the other edge of the apparatus 8, that is, the edge opposite from the pushing projection 9, and the pushing projections 11 (FIG. 10(*d*)). Therefore, as the toner supply container 1 was rotated in reverse after the toner discharge, the toner supply container 1 rotated alone until the pushing projections 11 came into contact with the edge of the apparatus shutter 8; in other words, the toner supply container 1 rotates alone by an angle proportional to the deviation H.

As a result, the peripheral surface of the container proper 1*a* of the toner supply container 1 was contaminated across the area, the size of which is proportional to the deviation H, with the toner having had accumulated across the bottom edge portion of the toner reception hole 7*b* during the toner reception (FIG. 10(*e*)). When the toner supply container 1 and toner receiving apparatus 7 is in the state shown in FIG. 10(*e*), the above-mentioned residual toner on the bottom edge portion of the toner reception hole 7*b* can not be recovered into the container proper 1*a*. Thus, it is highly possible that as the toner supply container 1 is further rotated in reverse to be restored to the state shown in FIG. 10(*a*), that is, to reseal the toner reception hole 7*b*, the residual toner, or the toner which failed to be recovered into the main assembly of the image forming apparatus, will enter the gap between the container proper 1*a* and apparatus shutter 8.

After the removal of the toner supply container 1, it was confirmed that the external surfaces of the toner supply container 1 and toner receiving apparatus 7 had been contaminated with toner.

From the above-described results, it was possible to confirm the effectiveness of the shutter movement regulating portions (claw-like portion 6*b* of connective projection 6, hooking projection 10, etc., in above-described embodiments) in accordance with the present invention.

COMPARATIVE EXAMPLE 3

Figure 11:
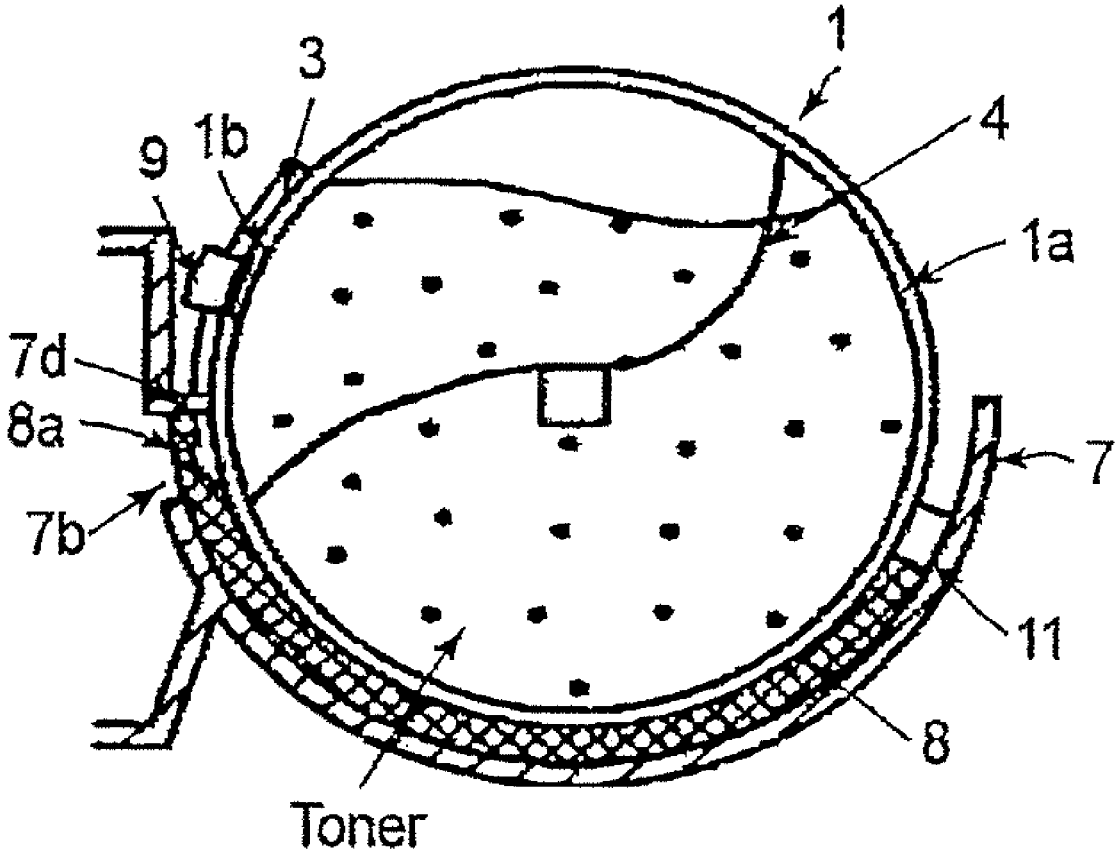
FIG. 11 is a sectional view of the toner supply container in the third comparative example, showing the state of the toner supply container immediately after the mounting of the toner supply container into the toner receiving apparatus during the toner supplying operation.

Next, referring to FIG. 11, the structure of the toner supply container 1 in the third comparative example, and the toner supplying operation which employs the toner supply container 1 in the third comparative example, will be described.

The toner supply container 1 in the third comparative example is provided with a container shutter 3 as are toner supply containers 1 in the first and second embodiments, in addition to the structural feature of the toner supply container 1 in the second comparative example. The structures of the other portions of the toner supply container 1 than the container shutter 3, and the structure of the toner receiving apparatus 7, are the same as those of the toner supply container 1 and toner receiving apparatus 7 in the second comparative example.

The toner supply container 1 structured as described above was subjected to the same tests as those to which the toner supply container 1 in the second comparative example was subjected, yielding the following results. That is, the contamination of the peripheral surface of the container proper 1*a* by the residual toner having accumulated across the bottom edge portion of the toner reception hole 7*b* during the toner reception, which occurred as it did in the second comparative example, was covered with the container shutter 3.

However, the toner supply container 1 rotated alone, as it did in the second comparative example, until the pushing projections 11 came into contact with the edge of the apparatus shutter 8. Therefore, the residual toner was not prevented from entering the gap between the container proper 1*a* and the apparatus shutter 8.

The removal of the toner supply container 1 revealed that the external surfaces of the toner supply container 1 and toner receiving apparatus 7 had been contaminated with toner. However, the contamination was less severe than that occurred in the second comparative example.

In other words, the above-described result also confirmed the effectiveness of the shutter movement regulating portions (claw-like portion 6*b* of connective projection 6, hooking projection 10, etc., in above-described embodiments) in accordance with the present invention.

[Miscellaneous]

In the above-described embodiments, the container proper of the developer supply container is roughly cylindrical. However, the embodiments are not intended to limit the scope of the present invention in terms of the configuration of the container proper. In other words, the container proper may be different in configuration from those in the above-described embodiments, as long as it can store developer.

Also in the above-described embodiments, the image forming apparatus was a copying machine. However, the present invention is also applicable to various image forming apparatuses other than a copying machine, as long as they form an image with the use of developer. For example, the present invention is applicable to such an image forming apparatus as a printer, a facsimile machine, a multifunction image forming apparatus capable of two or more functions of these apparatuses. It also is applicable to an image forming apparatus which comprises a transfer medium bearing member, such as a transfer medium conveyance belt, a transfer drum, etc., for holding a transfer medium in the form of a sheet or the like, and form an image on the transfer medium by sequentially laying multiple developer images different in color on the transfer medium. It also is applicable to an image forming apparatus which comprise an intermediary transferring member, such as an intermediary transfer belt, an intermediary transfer drum, etc., and forms an image on the transfer medium by sequentially transferring multiple developer images different in color, onto the intermediary transfer member, and then, transferring all at once the multiple developer images having been transferred in layers on the intermediary transferring member, onto the transfer medium. The application of the present invention to these image forming apparatuses yields the same effects as those yielded by the image forming apparatus in the first and second embodiments.

Further, the application of the present invention to a given image forming apparatus is not limited by the number of the developing apparatuses employed by the image forming apparatus. In other words, not only is the present invention applicable to an image forming apparatus having only one developing apparatus, but also, an image forming apparatus employing a plurality of developing apparatuses which are different in the color of the developer they use; the present invention is applicable to various image forming apparatuses regardless of the number of developing apparatuses they employ. The effects of the present invention remain the same whether the present invention is applied to an image forming apparatus having a single developing apparatus, or an image forming apparatus having multiple developing apparatuses.

Further, the application of the present invention is not limited to such a developer supply container as the developer supply containers, in the first and second embodiments, which is removably mounted into the main assembly of an image forming apparatus. Further, the present invention is applicable to a developer supply container structured so that it can be removably mounted into the process cartridge (equivalent to toner receiving apparatus) removably mounted in the main assembly of an image forming apparatus.

Incidentally, the above-mentioned process cartridge means a cartridge in which the above-described electrophotographic photosensitive member 104 as an image bearing member, and a minimum of one processing device among the charging device 203 which acts on this photosensitive member 104, developing device 201*a*, and cleaner 203, are integrally placed.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 388832 and 328675 filed Nov. 19, 2003 and Nov. 12, 2004, respectively, which are hereby incorporated by reference.

The invention claimed is:

1. A developer supply container detachably mountable to a developer receiving apparatus including a receiving opening and an apparatus shutter for opening and closing the receiving opening, wherein said apparatus shutter is in the form of a plate extending in a longitudinal direction of said container along a peripheral portion of said container, said developer supply container comprising:

a substantially cylindrical container body configured to contain the developer;

a discharge opening, formed in said peripheral portion of said container body configured to permit discharge of the developer from said container body;

a container shutter configured and positioned to open and close said discharge opening by an opening movement of said container body in a first rotational direction and a closing movement of said container body in a second rotational direction which is different from the first rotational direction respectively, said container shutter is in the form of a plate extending in the longitudinal direction of said container body along a peripheral portion of said container body; and a connecting portion provided on a peripheral portion of said container body and including a releasable snap-fit connection with said apparatus shutter by the opening movement of said container body, wherein said connecting portion interrelates the opening movement of said container body from a closing position where said discharge opening is not opposite to the receiving opening to an opening position where said discharge opening is opposite to the receiving opening with an opening movement of the apparatus shutter, such that the apparatus shutter which is locked by said connecting portion starts moving when a leading end of said discharge opening exposed by said container shutter in the first rotational direction is substantially aligned with a trailing end of the apparatus shutter in a rotational moving direction thereof, and wherein said connecting portion interrelates the closing movement of said container body from the opening position to the closing position with a closing movement of the apparatus shutter, such that a trailing end of said discharge opening in the second rotational direction is kept substantially aligned with a leading end of the apparatus shutter in a rotational moving direction during the closing the movement of the apparatus shutter.

2. A developer supply container according to claim 1, wherein said connecting portion is arranged such that the apparatus shutter starts moving when the leading end of said discharge opening is in a range of 5 mm from the trailing end of the apparatus shutter.

3. A developer supply container according to claim 1, wherein said connecting portion is released from the apparatus shutter by a further rotation, in the second rotational direction, of said container body after abutment of the apparatus shutter to a stopper of the developer receiving apparatus.

4. A developer supply container according to claim 1, wherein said developer supply container is inserted into the developer receiving apparatus, such that said discharge opening faces up.

* * * * *

UNITED STATES PATENT AND TRADEMARK OFFICE

CERTIFICATE OF CORRECTION

PATENT NO. : 7,426,363 B2
APPLICATION NO. : 11/833514
DATED : September 16, 2008
INVENTOR(S) : Katsuya Murakami et al.

It is certified that error appears in the above-identified patent and that said Letters Patent is hereby corrected as shown below:

COLUMN 2:
Line 26, "Application 199623" should read --Application 7-199623--.

COLUMN 4:
Line 3, "contain" should read --container--.

COLUMN 6:
Line 59, "an" should read --a--.

COLUMN 7:
Line 14, "length-wise" should read --lengthwise--.

COLUMN 8:
Line 30, "portion **6*b*," should read --portion 6b**--.

COLUMN 10:
Line 38, "becomes" should read --become--.
Line 66, "overlapped" should read --overlapped with--.

COLUMN 13:
Line 10, "minimizes" should read --minimize--.

COLUMN 14:
Line 40, "across" should read --across the--.
Line 55, "toner" should read --toner,--.
Line 56, "toner reception hole **7*b*" should read --toner reception hole 7*b***,--.

COLUMN 15:
Line 24, "minimizes" should read --minimize--.
Line 50, "example is" should read --example, it is--.
Line 58, "than" should read --other than--.

UNITED STATES PATENT AND TRADEMARK OFFICE

CERTIFICATE OF CORRECTION

PATENT NO. : 7,426,363 B2
APPLICATION NO. : 11/833514
DATED : September 16, 2008
INVENTOR(S) : Katsuya Murakami et al.

It is certified that error appears in the above-identified patent and that said Letters Patent is hereby corrected as shown below:

COLUMN 16:

Line 1, "toner" should read --toner,--.
Line 3, "charge" should read --charge,--.
Line 28, "first" should read --the first--.
Line 40, "those" should read --those which--.
Line 47, "(FIGS. 10(*b*)-10(*c*)." should read --(FIGS. 10(*b*) and 10(*c*)).--.
Line 65, "can not" should read --cannot--.

COLUMN 18:

Line 20, "images" should read --images,--.

Signed and Sealed this

Tenth Day of March, 2009

John Doll

JOHN DOLL
*Acting Director of the United States Patent and Trademark Office*